US006390835B1

(12) United States Patent
Okabe et al.

(10) Patent No.: US 6,390,835 B1
(45) Date of Patent: May 21, 2002

(54) CONNECTOR CONNECTING STRUCTURE

(75) Inventors: Toshiaki Okabe; Kenji Oishi, both of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/612,131

(22) Filed: Jul. 7, 2000

(30) Foreign Application Priority Data

Jul. 8, 1999 (JP) ..... 11-194979
Jul. 12, 1999 (JP) ..... 11-197859
Jul. 12, 1999 (JP) ..... 11-197885

(51) Int. Cl.[7] ..... H01R 13/62
(52) U.S. Cl. ..... 439/157; 439/372
(58) Field of Search ..... 439/157, 572, 439/152, 160

(56) References Cited

U.S. PATENT DOCUMENTS 3,516,042 A * 6/1970 Wagner ..... 439/160
6,120,308 A * 6/1998 Hayashi ..... 439/157
5,921,791 A * 7/1999 Ono et al. ..... 439/157
6,276,948 B1 * 8/2001 Okabe ..... 439/157

FOREIGN PATENT DOCUMENTS

JP 10-21992 1/1998

* cited by examiner

*Primary Examiner*—Neil Abrams
*Assistant Examiner*—Javaid Nasri
(74) *Attorney, Agent, or Firm*—Finnegan, Henderson, Farabow, Garrett, & Dunner, L.L.P.

(57) ABSTRACT

A connector connecting structure comprises, a first connector 50 held by a connector holding member 30, and a second connector 90 to be fitted to the first connector 50. The first connector is provided with turning levers 70A, 70B which are temporarily engaged with the connector holding member 30 before the second connector 90 is fitted to the first connector 50, and when the second connector 90 is fitted to the first connector 50, the turning levers 70A, 70B are turned by a fitting operation therebetween and finally engaged with the connector holding member 30. The turning levers 70A, 70B are provided on one end with a pair of sandwiching projections 74, 75 located on a front face side and a back face of a holding wall of the connector holding member 30 for sandwiching the holding wall. A resilient arm 76 is provided on a portion of at least the back face side which abuts against the holding wall of the sandwiching projection.

13 Claims, 18 Drawing Sheets

CONNECTOR CONNECTING STRUCTURE

BACKGROUND OF THE INVENTION

1. Field of the Invention

The present invention relates to a connector connecting structure including a first connector which is held by a connector holding member and a second connector which is fitted to the first connector.

2. Description of the Related Art

Conventionally, as a connector connecting structure of this kind, there is known a technique as described in Japanese Patent Application Laid-open No. H10-21992. This prior art has a structure as shown in FIGS. 1 to 5. A connecting mechanism of this conventional connector will be explained with using FIGS. 1 to 5 below.

This connector connecting mechanism comprises a holder 2 (corresponding to a connector holding member) mounted into a mounting hole 1A formed in a subject member 1 such as a stay member of an automobile as shown in FIG. 1, a first connector 3 which is slidably fitted in the holder 2, a second connector 5 connected to an electronic unit 4 and fitted to the first connector 3. A swinging lever 6 for driving the second connector 5 into a direction to connect with the first connector 3 is turnably supported around a pivot 6A by the first connector 3.

The holder 2 is formed into a substantially prism shape, and includes a pair of upper and lower horizontal plates 7, 8, and a pair of left and right side plates 9, 10 as shown in FIG. 1. The holder 2 is inserted into the mounting hole 1A formed in the mounting member 1 and fixed therein by fixing means such as screw.

The side plates 9, 10 of the holder 2 are formed at their inner wall surfaces with guide grooves 11, 12 along the longitudinal direction for slidably guiding the first connector. The horizontal plate 7 is formed with a guide groove 13 with which an engaging pin 6B projecting from an upper surface of a rear end of the swinging lever 6 is engaged and guided. The guide groove 13 comprises an introducing portion 13A rearwardly extending from a front end of the holder 2, an arc driving grove portion 13B extending from an end of the introducing portion 13A rearwardly and inwardly, and a locking groove portion 13C extending from an end of the driving groove portion 13B rearwardly. The driving groove portion 13B guides the engaging pin 6B along an arc as the,first connector 3 is inserted into the holder 2, and the swinging lever 6 is rotated by the motion of the engaging pin 6B.

An engaging groove 16 is formed in a lower surface of a front end of the swinging lever 6. This engaging groove 16 includes an opening 16A which is an introducing/guiding portion of a driven pin 5A and an operation groove 16B which is continuously formed with the opening 16A and extending inward of a rear portion of the swinging bar 6.

A distance of the operation groove 16B with respect to the pivot 6A is set such that a distance between the operation groove 16B and the pivot 6A which is the swinging fulcrum is gradually reduced from a front end to a rear end of the operation groove 16B. With this design, a driving force input from the driving groove 13B to the swinging lever 6 is transmitted through the second connector 5 to move the latter in a direction in which it is connected to the first connector 3.

That is, when the first and second connectors 3, 5 are connected, as the first connector 3 is pushed into the holder 2 and slid and deformed, the operation groove 16B pulls the driven pin 5A toward the pivot 6A by the turning movement of the swinging lever 6, thereby moving the second connector 5 into the direction in which the second connector 5 is connected to the first connector 3, i.e., into the connecting side.

Positions and shapes of the driving groove 13B of the guide groove 13 with respect to the pivot 6A and the operation groove 16B of the engaging groove 16 are set such that a moving amount of the second connector 5 into the connection direction becomes smaller than a moving amount of the first connector 3 which is pushed into the holder 2. With this design, the driving force input to the swinging lever 6 is increased by the sliding operation at the time of connection, and the driving force is transmitted from the operation groove 16B to the driven pin 5A of the second connector 5.

Another swinging lever 6 is also provided on the other side face (lower face in FIG. 1) of the first connector 3, and another driven pin 5A projects from the other side face of the second connector 5.

In FIG. 1, the reference symbol 3A represents slide projections projecting from rear ends of opposite sides of the first connector 3. The slide projections 3A are guided by the guide grooves 11, 12 formed in the inner walls of the opposite side plates 9, 10.

As shown in FIGS. 1 and 3, a temporarily mounting portion 3B which is temporarily mounted on the projection 2B of the front end opening peripheral edge of the holder 2 is formed between the pair of slide projections 3A, 3A. As shown in FIGS. 1 and 2, falling-out preventing projections 3C, 3C which are prevented from falling out by falling-out preventing portions 2A, 2A are provided on the opposite sides of the rear end of upper and lower surfaces of the first connector 3.

The operation will be explained next.

When the first connector 3 and the second connector 5 having the above structure are connected, the first connector 3 is inserted into the holder 2 in a state where the first connector 3 is opposed to a tip end opening of the holder 2. Then, the projections 3C of the first connector 3 ride over the falling-out preventing portions 2A and 2A of the holder 2 (see FIG. 2) in accordance with the inserting operation, and the temporarily mounting portions 3B of the first connector 3 abut against the projections 2B of the holder 2 (see FIG. 3). With this operation, the first connector 3 is temporarily mounted in a state where the first connector 3 is prevented from falling out. At the same time, the engaging pin 6B projecting from the rear end of the swinging lever 6 is introduced into the guide groove 13 of the holder 2.

At this stage, the holder 2 is fixed to the mounting member 1. In this stage, the first connector 3 is temporarily mounted to the holder 2, and the first connector 3 projects from the holder 2.

Next, the second connector 5 is fitted to the first connector 3.

At that time, if the first connector 3 is pushed rearward by the second connector 5, the temporarily mounted state of the first connector 3 is released. The first connector 3 is slid deeply into the holder 2 and at the same time, the driven pin 5A of the second connector 5 is introduced into the engaging groove 16 of the swinging lever 6, and the driven pin 5A and the swinging lever 6 are engaged with each other.

From this state, if the second connector 5 is further pushed against the first connector 3, the first connector 3 is slid deeply into the holder 2 and deformed, and in accordance with this motion, the engaging pin 6B of the swinging lever 6 slides along the arc driving groove 13B of the guide groove 13 of the holder 2, and the rotation force is generated to turn the swinging lever 6. As the swinging lever 6 is turned, the driven pin 5A of the second connector 5 slides along the operation groove 16B of the engaging groove 16, the driven pin 5A is pulled toward the pivot 6A which is the swinging fulcrum, and the second connector 5 is moved toward the first connector 3, i.e., toward the connecting side.

At that time, since the guide groove 13 and the engaging groove 16 are formed such that a sliding displacement amount of the first connector 3 which swings and displaces the swinging lever 6 becomes smaller than a moving amount of the first connector 3 into a connecting direction with the second connector 5 which is driven by the swinging lever 6, the driving force input to the swinging lever 6 is increased and transmitted to from the engaging groove 16 to the driven pin 5A. As a result, the second connector 5 is easily connected to the first connector 3 with a small operating force.

Next, when the connection between the first connector 3 and the second connector 5 is released, the second connector 5 is pulled forward. With this operation, the engaging pin 6B slides on the guide groove 13, the swinging lever 6 is turned in a direction opposite from that at the time of connecting operation, and the driven pin 5A falls out from the engaging groove 16. At that time also, the connection is easily released by the pushing-back force having increased pulling-out force due to the relation between the guide groove 13 and the engaging groove 16.

In the above-described conventional connecting mechanism of the connectors, apart from the swinging lever 6 which finally connect the first connector 3 to the holder 2, means for temporarily engaging the first connector 3 with the holder 2 (corresponding to the projection 2B, the temporarily mounting portion 3B, the falling-out preventing portion 2A, the falling-out preventing projection 3C shown in FIGS. 2 and 3) are provided, there is a problem that the structure becomes complicated correspondingly.

Further, since the first connector 3 is finally engaged with the holder 2 when the engaging pin 6B reaches the locking groove portion 13C in the deep recess of the guide groove 13 formed in the holder 2, if the precision of size of each of the guide groove 13 and the engaging pin 6B is not high, there is an adverse possibility that rattle is generated at the time of final engagement. Further, nothing absorbs an error in size and the like in the final engaging state and a process up to the final engaging state. Therefore, if the size precision is enhanced, the swinging lever 6 does not move smoothly in some cases.

Further, in the above-described conventional connecting mechanism of the connectors, the rotational force is applied to the swinging lever 6 by the combination of the curved guide groove 13 and the engaging pin 6B which slides therein. The connector-connecting force and connector-separating force greater than the operating force are obtained by the combination of the curved engaging groove 16 and the driven pin 5A which slides therein. Therefore, it is indispensable to work the guide groove 13 and the engaging groove 16, which complicates the structure and therefore, workability at the time of resin forming is inferior (especially, mold-drawing is difficult).

Further, in the above-described conventional connecting mechanism of the connectors, when the first connector is temporarily mounted as shown in FIG. 4, the first connector 3 largely projects from the holder 2. Therefore, when the second connector 5 is fitted in that state, the second connector 5 collides against the first connector 3 and an excessive external force may be applied to the first connector 3 unintentionally. That is, since the first connector 3 largely projects forward, an unstable force is prone to be applied to the first connector 3 when the second connector 5 is fitted depending upon the operating state, and there is a problem that the temporarily mounted state is released and the second connector 5 is not fitted reliably.

SUMMARY OF THE INVENTION

It is an object of the present invention to provide a connecting structure of connector capable of simplifying the structure, eliminating the rattle in the mounted state, and smoothening a turning movement of a lever to smoothen the mounting operation.

It is another object of the invention to provide a connecting structure of connector capable of eliminating the need for forming a curved groove, thereby facilitating the working operation of the resin.

It is another object of the invention to provide a connecting structure of connector in which unnecessary or excessive force is not applied unintentionally to connectors when the connectors are fitted to each other, and the connectors can be reliably fitted to each other while maintaining a stable temporarily mounted state.

According to a first aspect of the invention, there is provided a connector connecting structure comprising, a connector holding member, a first connector held by the connector holding member, a second connector to be fitted to the first connector, a turning lever provided on the first connector, temporarily engaged with the connector holding member before the second connector is fitted to the first connector, and when the second connector is fitted to the first connector, the turning lever being turned by a fitting operation therebetween and finally engaged with the connector holding member, a pair of sandwiching projections provided on one end of the turning lever, located on a front face side and a back face side of a holding wall of the connector holding member for sandwiching the holding wall, and a resilient arm provided on a portion of at least the back face side which abuts against the holding wall of the sandwiching projection.

According to this arrangement, temporarily engagement and final engagement with respect to the connector holding member can be carried out by a turning position of one turning lever. At that time, error in size influencing the engaged portion can be absorbed by the resilient arm provided on the sandwiching projection. Further, unnecessary force generated when the turning lever is turned can be absorbed by the resilient arm. Further, the sandwiching projection can be slid and engaged with the position-restricting projection or recess utilizing deformation of the resilient arm.

According to a second aspect of the invention, in the connector connecting structure of the first aspect, the holding wall is provided with a position-restricting portion for restricting an engaging position of the sandwiching projection.

According to this arrangement, it is possible to slide and engage the sandwiching projection with the position-restricting projection or recess utilizing the deflection of the resilient arm provided on the sandwiching projection. In the temporarily engaged state, it is easy to positioning the members at the time of the fitting operation of the second connector by restricting the position of the sandwiching projection by the position-restricting portion.

According to a third aspect of the invention, in the connector connecting structure of the second aspect, the position-restricting portion restricts the position of the sandwiching projection with a predetermined backlash.

According to this arrangement, a certain backlash can be secured in a state in which the position of the sandwiching projection is restricted by the position-restricting portion. Therefore, when the second connector is fitted to the first connector in the temporarily engaged state, the first connector can automatically be aligned by an alignment mechanism.

According to a fourth aspect of the invention, there is provided a connector connecting structure comprising, a connector holding member, a first connector held by the connector holding member, a second connector to be fitted to the first connector, a turning lever provided on the first connector, temporarily engaged with the connector holding member before the second connector is fitted to the first connector, and when the second connector is fitted to the first connector, the turning lever being turned by a fitting operation therebetween and finally engaged with the connector holding member, and a driving projection provided on the turning lever, the driving projection being pushed and moved by a front end face of the second connector when the second connector is fitted to the first connector, thereby applying a rotational driving force to the turning lever.

According to this arrangement, if the second connector is pushed toward the first connector which is temporarily engaged with the connector holding member by the turning lever, the front end face of the second connector abuts against the driving projection, and the latter is pushed and moved. As a result, the turning lever is turned and finally engaged with the connector holding member, and the second connector is fitted to the first connector.

According to a fifth aspect, there is provided a connector connecting structure comprising, a connector holding member, a first connector held by the connector holding member, a second connector to be fitted to the first connector, a turning lever provided on the first connector, temporarily engaged with the connector holding member before the second connector is fitted to the first connector, and when the second connector is fitted to the first connector, the turning lever being turned by a fitting operation therebetween and finally engaged with the connector holding member, and a driving projection provided on the turning lever, the driving projection amplifying a pulling-out force acting on an engaged point between the turning lever and the connector holding member by an action of a lever utilizing rotation of the turning lever, and transmitting the pulling-out force as a pushing force for separating the second connector to a front end face of the second connector.

According to this arrangement, when the second connector which is fitted to the first connector is separated, if the pulling-out force is applied to the second connector, the pulling-out force is applied to the engaged point between the connector holding member and the turning lever, and the latter is turned into the separation direction. When the turning lever is turned, the pulling-out force applied to the engaged point is amplified by the action of a lever by the turning lever, and this force is transmitted from the driving projection to the front end face of the second connector as a pushing force. Therefore, it is possible to easily separate the second connector even with a small pulling-out operation.

According to a sixth aspect of the invention, there is provided a connector connecting structure comprising, a connector holding member, a first connector held by the connector holding member, a second connector to be fitted to the first connector, a turning lever provided on the first connector, temporarily engaged with the connector holding member before the second connector is fitted to the first connector, and when the second connector is fitted to the first connector, the turning lever being turned by a fitting operation therebetween and finally engaged with the connector holding member, and a driving projection provided on the turning lever, the driving projection being pushed and moved by a front end face of the second connector when the second connector is fitted to the first connector, thereby applying a rotational driving force to the turning lever, and the driving projection amplifying a pulling-out force acting on an engaged point between the turning lever and the connector holding member by an action of a lever utilizing rotation of the turning lever, and transmitting the pulling-out force as a pushing force for separating the second connector to a front end face of the second connector.

According to this arrangement, if the second connector is pushed and moved toward the first connector, the front end face abuts against the driving projection, and the latter is pushed and moved so that the turning lever is finally engaged with the connector holding member, and the second connector is fitted to the first connector. If the pulling-out force is applied to the second connector, the pulling-out force acts on the engaged point between the turning lever and the connector holding member, the turning lever is turned into the separation direction, the pulling-out force acting on the engaged point is amplified by the action of the lever due to the rotation of the turning lever, and the force is transmitted from the driving projection to the front end face of the second connector as a pushing force. Therefore, it is possible to easily separate the second connector even with a small pulling-out operation.

According to a seventh aspect of the invention, the connector connecting structure according further comprises a pair of sandwiching projections provided on one end of the turning lever, located on a front face side and a back face side of a holding wall of the connector holding member for sandwiching the holding wall, and a pulling-out force is applied to the sandwiching projection on the back face side at the time of connector separating operation, and a force for turning the turning lever into a separation direction is generated by the pulling-out force.

According to this arrangement, the first connector is finally engaged with the connector holding member by sandwiching the holding wall of the holding member by the pair of sandwiching projections provided on the turning lever. Further, if the pulling-out force is applied for separating the second connector in this state, the pulling-out force acts on the sandwiching projection of the back face side of the holding wall, and the turning lever is turned in the separation direction by the pulling-out force. A pushing and returning force which was amplified by the action of the lever is transmitted to the front end face of the second connector from the driving projection by the rotation of the turning lever, and the second connector is easily separated.

According to an eighth aspect of the invention, the connector connecting structure comprises, a connector holding member, a first connector held by the connector holding member, and a second connector to be fitted to the first connector, wherein the connector holding member is provided at its front face wall with a recess, an inner peripheral wall of the recess is formed as a hood portion for fitting and guiding the connector when the second connector is fitted to the first connector, and the first connector is disposed on a bottom wall of the recess.

According to this arrangement, even if an attempt is made to fit the second connector to the first connector in a state in which the position of the second connector is deviated, the second connector first abuts against the front face wall of the connector holding member or the inner peripheral wall of the recess as the hood portion. Since the second connector is guided by the inner peripheral wall of the recess as the hood, even when the first connector is temporarily engaged, the temporarily engaged state is not released, and it is possible to fit the second connector to the first connector 50 with appropriate force and direction.

According to a ninth aspect of the invention, in the connector connecting structure of the eighth aspect, a front end of the first connector is positioned on a location equal to the front face wall of the connector holding member or a location recessed into the recess.

According to this arrangement, since the first connector is disposed such as to be recessed in the recess from the front face wall of the connector holding member, when the second connector is fitted, the second connector should not hit the first connector nor an excessive lateral force should not be applied to the first connector by carelessness.

According to a tenth aspect of the invention, the connector connecting structure of the eighth aspect further comprises engaging means provided on the first connector, wherein the engaging means is temporarily engaged with the connector holding member before the second connector is fitted to the first connector, and the engaging means is finally engaged with the connector holding member by fitting the second connector to the first connector.

According to this arrangement, since the first connector is provided with the engaging means, it is possible to temporarily engage the first connector with the connector holding member before the second connector is fitted. Further, the first connector can be finally engaged with the connector holding member using the engaging means by fitting the second connector to the first connector.

According to an eleventh aspect of the invention, in the connector connecting structure of the tenth aspect, the engaging means is a turning lever provided on the first connector, temporarily engaged with the connector holding member before the second connector is fitted to the first connector, and when the second connector is fitted to the first connector, the turning lever being turned by a fitting operation therebetween and finally engaged with the connector holding member.

According to this arrangement, the temporarily engaging operation and the final engaging operation can be carried out separately by the turning position of the turning lever provided as the engaging means.

According to a twelfth aspect of the invention, in the connector connecting structure of the eleventh aspect, the turning lever is provided at its one end with a pair of sandwiching projections respectively located on a front face side and a back face side of a bottom wall of the recess, the sandwiching projections sandwich the bottom wall, thereby engaging the connector holding member, and the sandwiching projections temporarily engage and finally engage the connector holding member by a positional relation of the pair of the sandwiching projections with respect to a turning position of the turning lever.

According to this structure, it is possible to engage the first connector with the connector holding by sandwiching the recess bottom wall between the pair of sandwiching projections provided on the turning lever. Further, the turning lever which was temporarily engaged with the connector holding member can be finally engaged with the connector holding member by turning the turning lever by the fitting operation of the second connector.

BRIEF DESCRIPTION OF THE DRAWINGS

FIGS. 7A, 7B and 7C show a structure of a first connector body constituting a first connector shown in FIG. 6, wherein FIG. 7A is a plan view, FIG. 7B is a side view, and FIG. 7C is a front view;

FIGS. 8A, 8B and 8C show a structure of a left turn lever constituting the first connector shown in FIG. 6, wherein FIG. 8A is a plan view, FIG. 8B is a view taken along the arrow VIIIB—VIIIB in FIG. 8A, and FIG. 8C is a view taken along the arrow VIIIC—VIIIC in FIG. 8A;

DETAILED DESCRIPTION OF THE PREFERRED EMBODIMENT

An embodiment of the present invention will be explained with reference to the drawings below.

Figure 1:
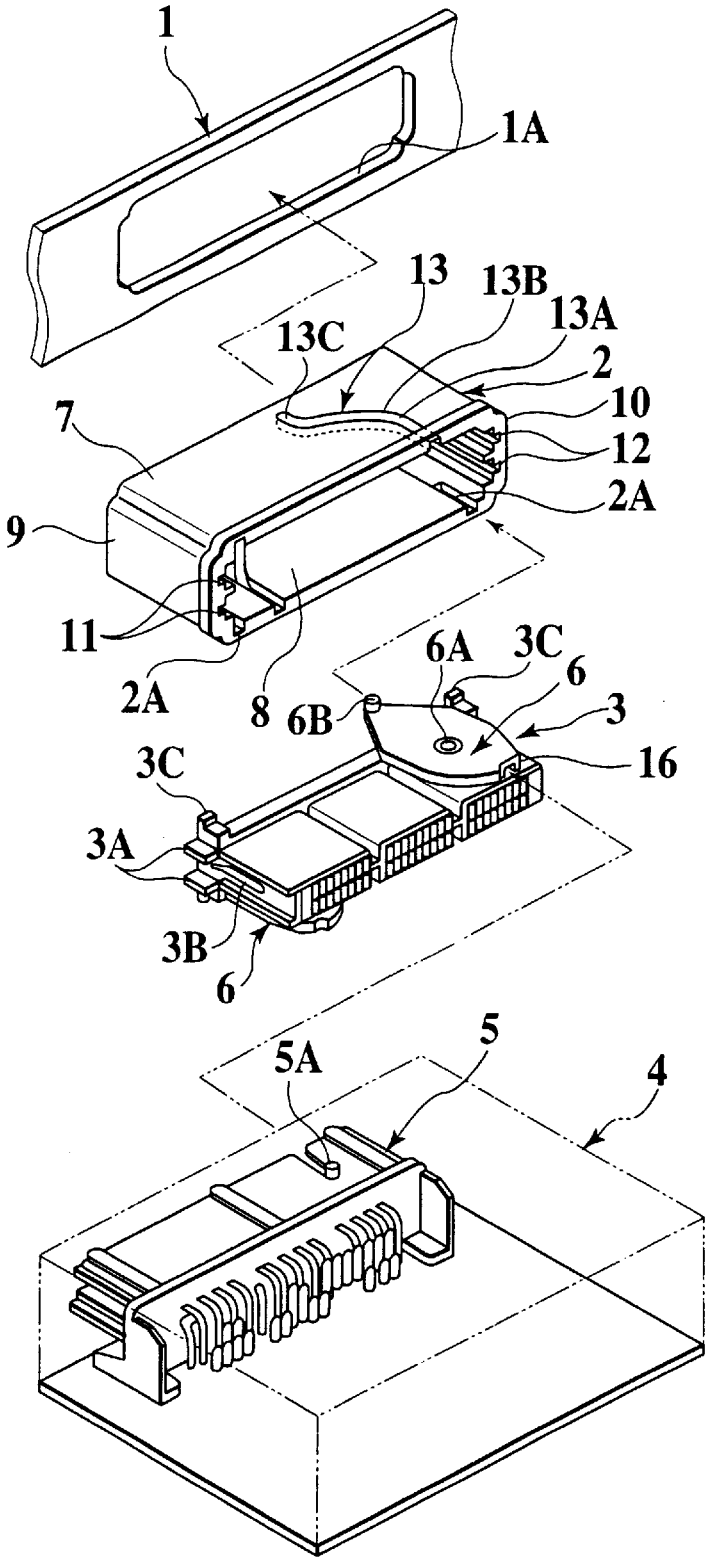
FIG.1 PRIOR ART
FIG. 1 is an exploded perspective view showing a conventional connector connecting structure.
Figure 2:
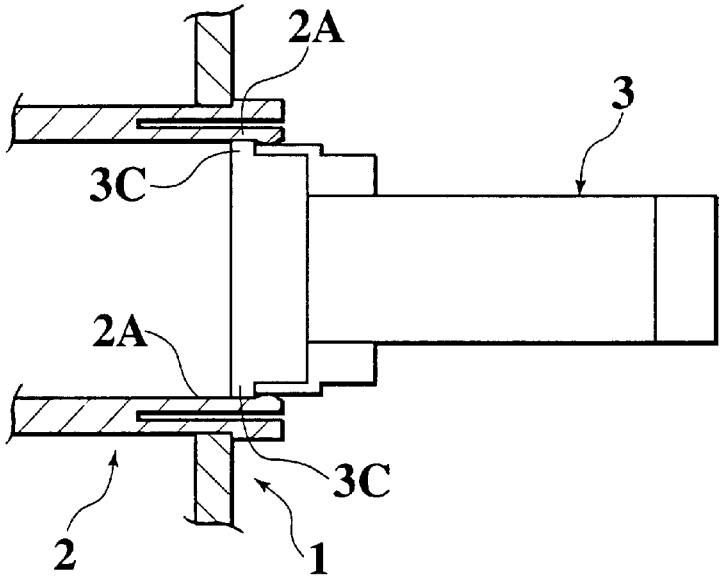
FIG.2 PRIOR ART
FIG. 2 is a partial sectional view of the conventional connector connecting structure.
Figure 3:
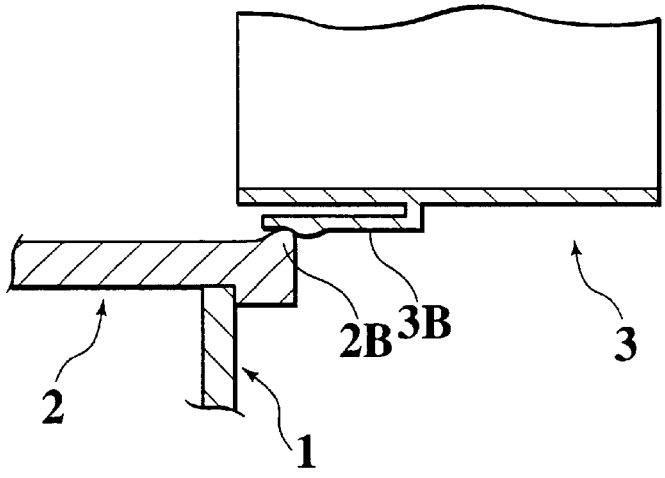
FIG.3 PRIOR ART
FIG. 3 is another partial sectional view of the conventional connector connecting structure.
Figure 4:
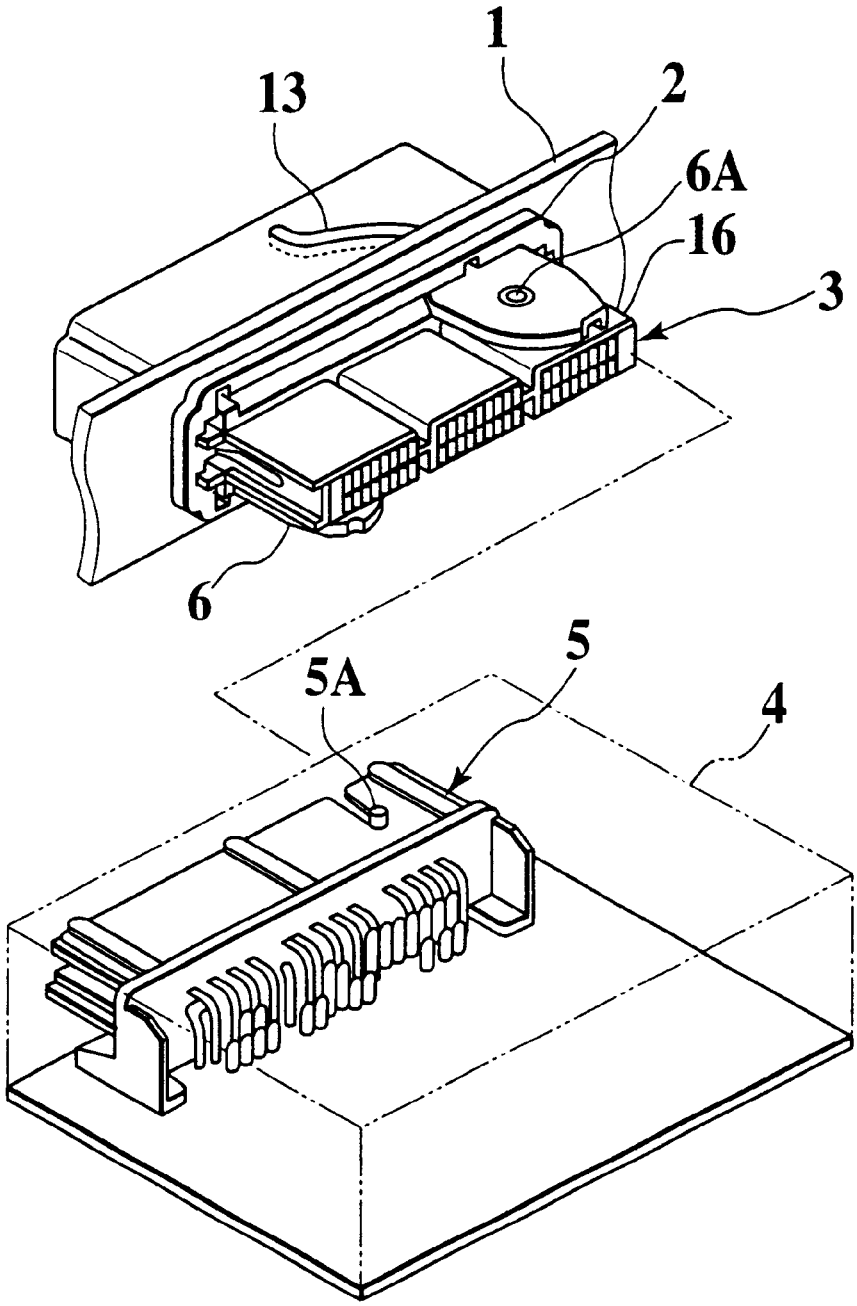
FIG.4 PRIOR ART
FIG. 4 is a perspective view showing the conventional connector connecting structure before a second connector is fitted.
Figure 5:
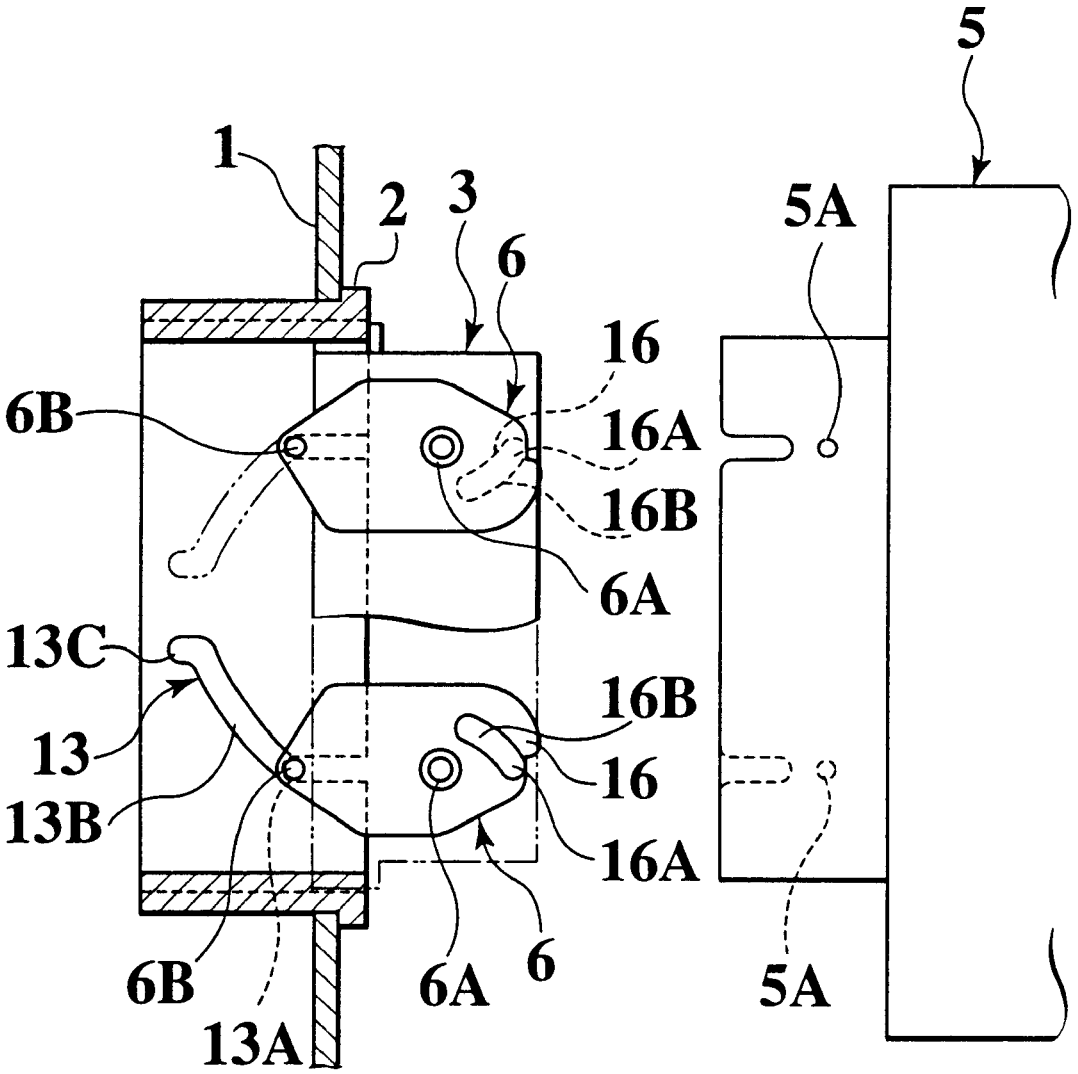
FIG.5 PRIOR ART
FIG. 5 is a plan view showing a relation of essential portions of a mechanism of the conventional connector connecting structure.
Figure 6:
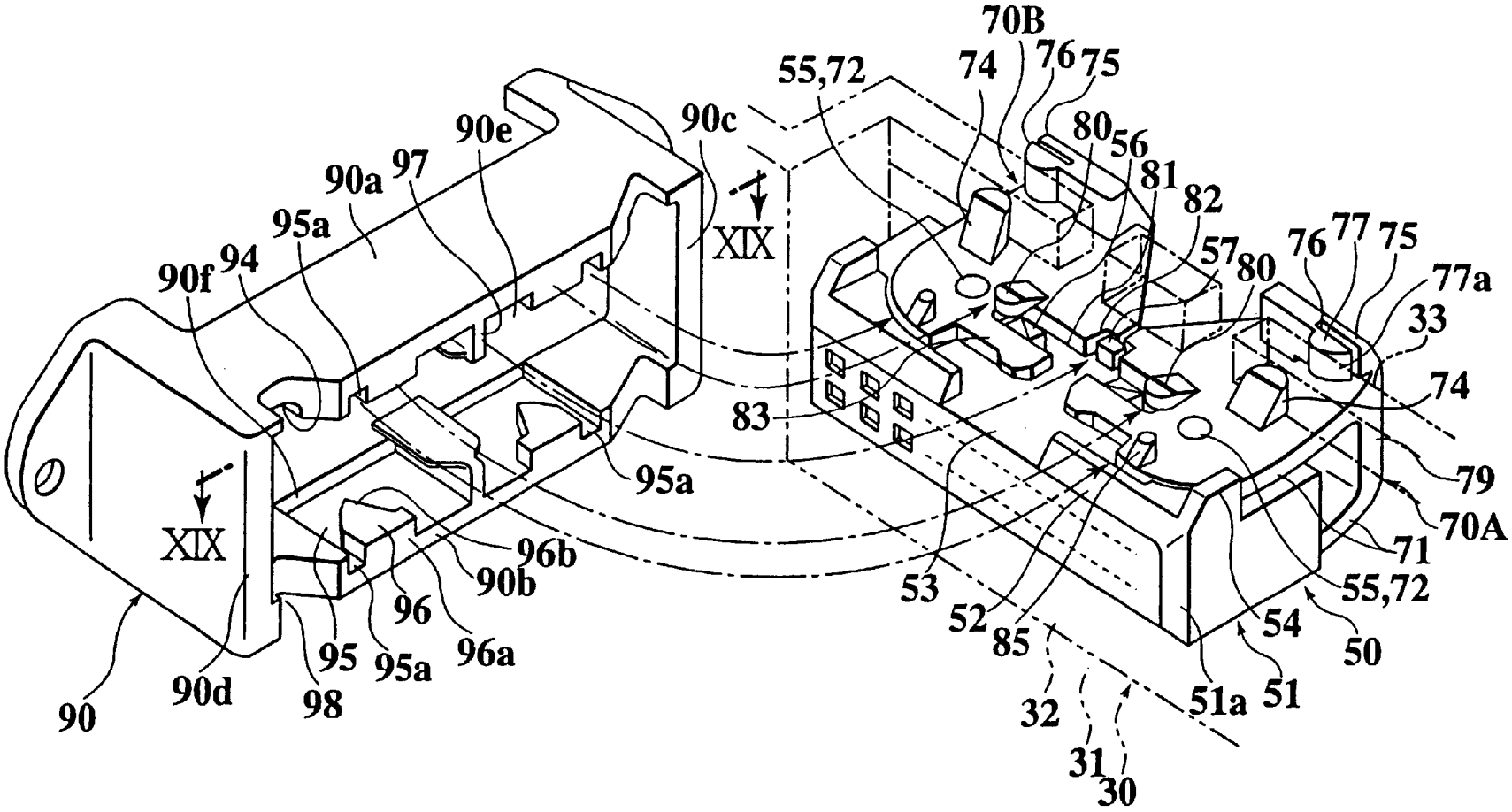
FIG. 6 is a perspective view of a connector connecting structure of an embodiment of the present invention before connectors are fitted to each other.

FIG. 6 is a perspective view of a connector connecting structure of the embodiment. The connector connecting structure comprises a connector holding member 30 shown with phantom lines in FIG. 6, a first connector 50, and a second connector 90. Here, the first connector 50 is a female connector, and the second connector 90 is a male connector.

The connector holding member 30 is a molded resin fixed to a stay member or the like of an automobile for example, and is provided at its front wall 31, and a recess 32 for accommodating the first connector 50, and the first connector 50 can be mounted to a holding wall 33 which is a bottom wall of the recess 32.

The first connector 50 comprises a first connector body 51 into which a large number of female terminal metal fittings are accommodated, and a pair of left and right turning levers 70A, 70B mounted to the rear portion of the first connector body 51.

Male terminal metal fittings are mounted to the second connector 90, and a body of the second connector 90 is formed into a substantially prism shape comprising a hood upper wall 90*a,* a hood lower wall 90*b,* hood left and right side walls 90*c,* 90*d.*

These first connector body 51, the turning levers 70A, 70B, and the second connector 90 are also molded resin.

Details of each part will be explained below.

[First Connector Body]

Figure 7A:
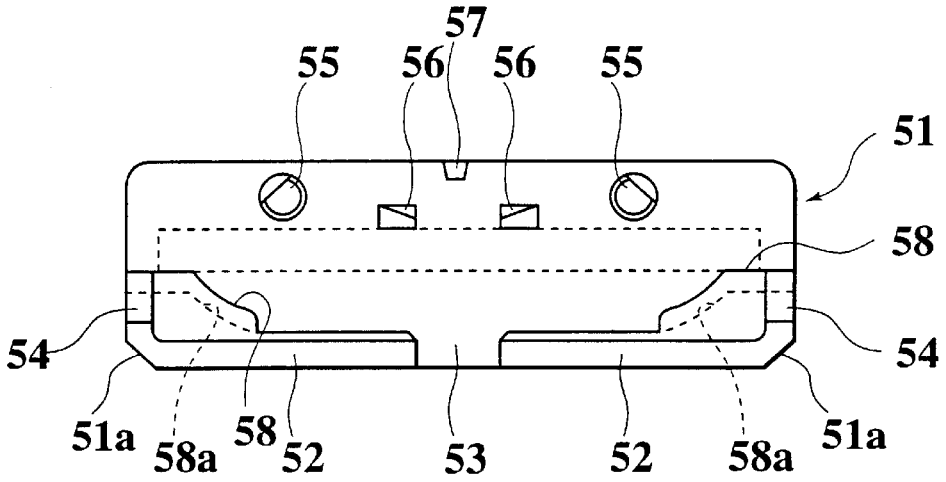
Figure 7B:
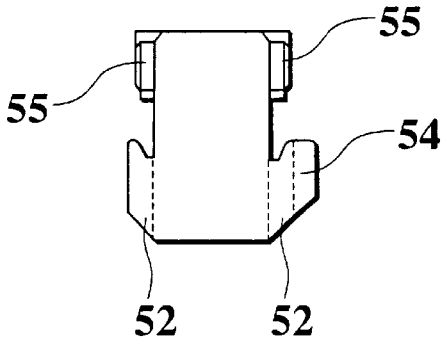
Figure 7C:
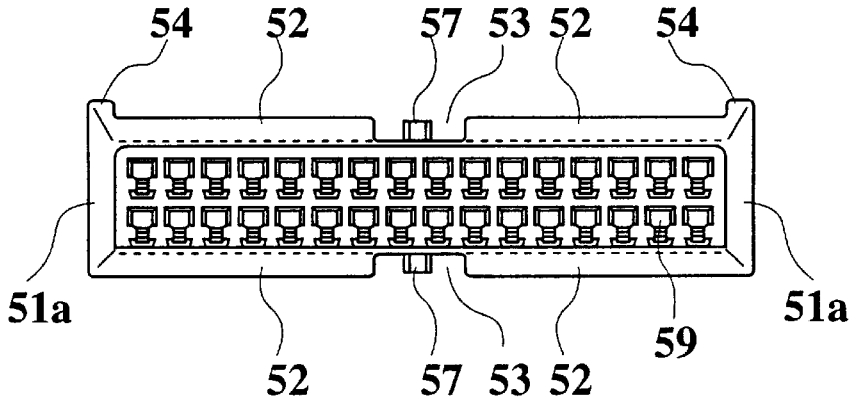

FIGS. 7A, 7B and 7C show a structure of the first connector body, wherein FIG. 7A is a plan view, FIG. 7B is a side view, and FIG. 7C is a front view.

The first connector body 51 is formed into a substantially rectangular prism shape, and is provided at its front end left and right edges with chamfered portions 51*a* for fitting and guiding mating connectors. Guide steps 52 for fitting and guiding the mating connectors are formed on regions of the first connector body 51 from front end upper and lower edges and upper and lower faces. Each of the guide steps 52 is higher by one step from upper and lower faces of the first connector body 51, and including inclined surfaces so that its front end face can fit and guide the mating connector. Each of the guide steps 52 is formed such as to be bifurcatea in the right and left directions, and is provided at its central portion with a central notch 53. The guide steps 52 are provided at their left and right edges with guide projections 54 projecting in the vertical direction and extending in the lateral direction. Each the guide step 52 is provided with an arc edge wall 58 forming an arc groove 58*a* between the upper and lower faces of the first connector body 51.

Turning pins 55, 55 for pivotally supporting turning levers 70A, 70B (see FIG. 6) project from left and right predetermined positions in the vicinity of rear ends of the upper and lower faces of the first connector body 51. A pair of left and right first locking projections 56, 56, and a central second locking projection 57 are provided in region between the left and right turning pins 55, 55. In this case, the first locking projections 56, 56 are provided at front side thereof with downwardly inclined faces.

The first connector body 51 is formed with a terminal accommodating chambers 59 passing through the first connector body 51 in the longitudinal direction. The female terminal metal fittings are accommodated and disposed in the terminal accommodating chambers 59. Electric wires are respectively connected to the female terminal metal fittings, the electric wires are pulled out from the rear end of the first connector body 51 and guided to a back side of a mounting opening 37 (undermentioned stay member or the like) of the connector holding member 30.

[Turning Lever]

Figure 8A:
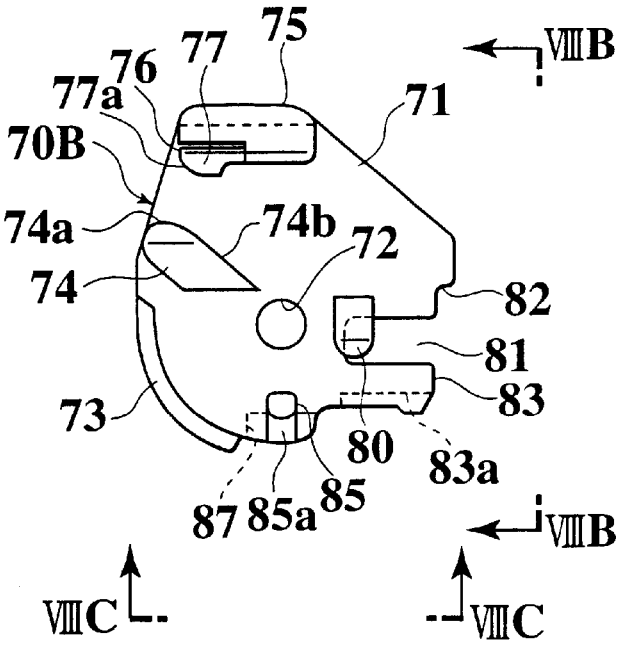
Figure 8B:
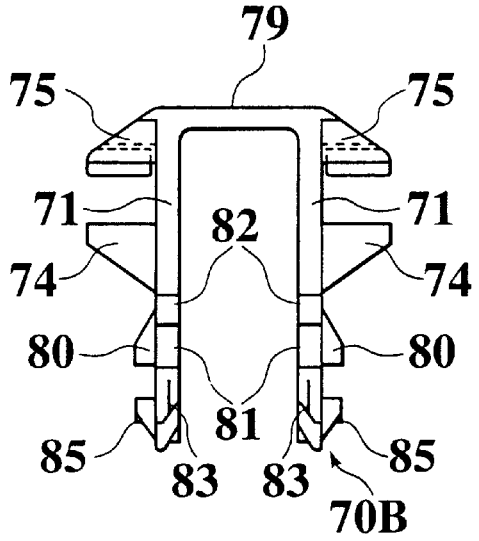
Figure 8C:
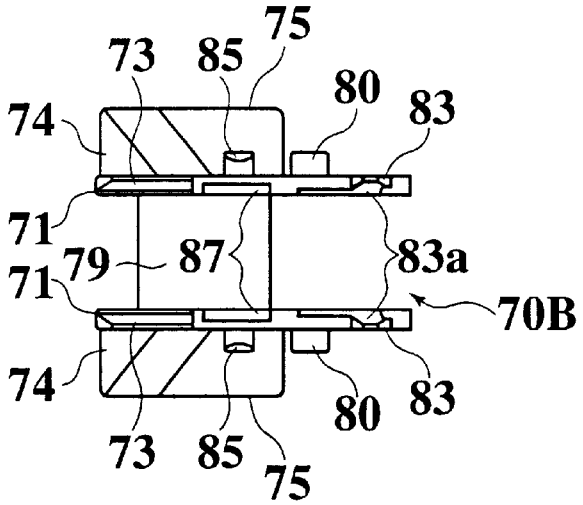

FIGS. 8A, 8B and 8C show a structure of the left turn lever 70B shown in FIG. 6, wherein FIG. 8A is a plan view, FIG. 8B is a view taken along the arrow VIIIB—VIIIB in FIG. 8A, and FIG. 8C is a view taken along the arrow VIIIC—VIIIC in FIG. 8A. The right turning lever 70A is laterally symmetric with the left turning lever 70B and therefore, explanation of the right turning lever 70A is omitted, and the left turning lever 70B will be explained as representative.

The left turning lever 70B has a U-shape side face comprising a pair of upper and lower lever plates 71, 71, and connecting plate 79 for connecting the lever plates 71, 71. The front and back faces of the two lever plates 71, 71 are symmetric. Here, one of the lever plates 71, 71 will be explained.

The lever plate 71 is provided at its substantially center portion with a pinhole 72. As shown in FIG. 6, the turning lever 70B is rotatably mounted to the first connector body 51 by fitting the pinholes 72 of the upper and lower lever plates 71, 71 to the turning pins 55, 55 of the upper and lower faces of the first connector body 51.

For explaining the lever plate 71, directivity thereof is defined as follows as a matter of convenience. Here, in an initial state shown in FIG. 6 where the two turning levers 70A, 70B are mounted to the first connector body 51, a side where the turning levers 70A, 70B are adjacent to each other is defined as "lever inner side", and the opposite side is defined as "lever outer side". A side of the lever located on the front end of the first connector body 51 is defined as "lever front side", and the opposite side is defined as "lever rear side".

As shown in FIG. 8A, an ark projecting edge 73 describing an arc around the pinhole 72 is provided on the lever front side and the lever outer side of a periphery of the lever plate 71. The ark projecting edge 73 is slidably inserted in an arc groove 58*a* of the arc edge wall 58 of the guide step 52 provided on the first connector body 51.

The lever inner side of the periphery of the lever plate 71 is provided with a locking arm 83, a larger first locking notch 81, and a smaller second locking notch 82 in this order from the lever front side. The locking arm 83 is formed at its front end lower edge with an inclined face 83*a*.

As shown in FIG. 8A, a first sandwiching projection 74 projects from a surface located on the side of the lever outer side diagonally rearward of the pinhole 72. The first sandwiching projection 74 is provided at its peripheral surface with a cylindrical sandwiching surface 74*a* located on the opposite side of the pinhole 72, and a flat sandwiching surface 74*b* comprising a flat surface substantially in parallel to a diameter passing through the pinhole 72 and smoothly continuous with the cylindrical sandwiching surface 74*a*.

A second sandwiching projection 75 projects from the lever rear side of the first sandwiching projection 74 such as to be opposed to the first sandwiching projection 74 at a predetermined distance. The second sandwiching projection 75 is of rectangular shape which is longer in the lateral direction of the lever plate 71 (in a direction perpendicular to the longitudinal direction of the lever), and the lever front side face is provided with a resilient arm 76.

The resilient arm 76 has one end located at the lever inner side and functioning as a fulcrum, and a free tip end which is the other end extended toward the lever outer side. The resilient arm 76 can be deformed in the longitudinal direction of the lever (the vertical direction in FIG. 8A). The free tip end of the resilient arm 76 is provided at its front face with a substantially semi-circular locking projection 77 as viewed on a plane, and the lever front side peripheral face of the locking projection 77 is formed as a cylindrical sandwiching surface 77*a*.

A driving projection 80 projects from a surface of the lever plate 71 located closer to the lever inner side than the pinhole 72. A lever front side peripheral face of the driving projection 80 is formed into a cylindrical face.

The lever plate 71 is provided at its lever front end surface with a locking projection 85 located just in front of the pinhole 72. A portion of the locking projection 85 on the lever front side is formed as a guide inclined face 85*a* which is inclined downward. A back side of the locking projection 85 is provided with a notched inclined face 87.

If a distance between the center of the pinhole 72 and the driving projection 80 and a distance between the center of the pinhole 72 and the locking projection 77 of the second sandwiching projection 75, the former distance is set very smaller than the latter distance. This is for generating a connector separating force which is greater than a connector pulling out force. Details thereof will be explained latter.

As shown in FIGS. 8B and 8C, the driving projection 80 and the locking projection 85 are set low in height, and the first and second sandwiching projections 75, 74 are set higher than the driving projection 80 and the locking projection 85.

As shown in FIG. 6, the pair of right and left turning levers 70A, 70B are turnably mounted to the first connector body 51 by fitting the pinholes 72 of the lever plates 71, 71 to the turning pins 55, 55 projecting from the upper and lower faces of the first connector body 51, thereby constituting the first connector 50.

In the initial state, the first locking projection 56 engages the first locking notch 81, and the second locking projection 57 engages the second locking notch 82 so that the right and left turning levers 70A, 70B are prevented from rotating unintentionally in left nor right direction.

[Connector Holding Member]

Figure 9:
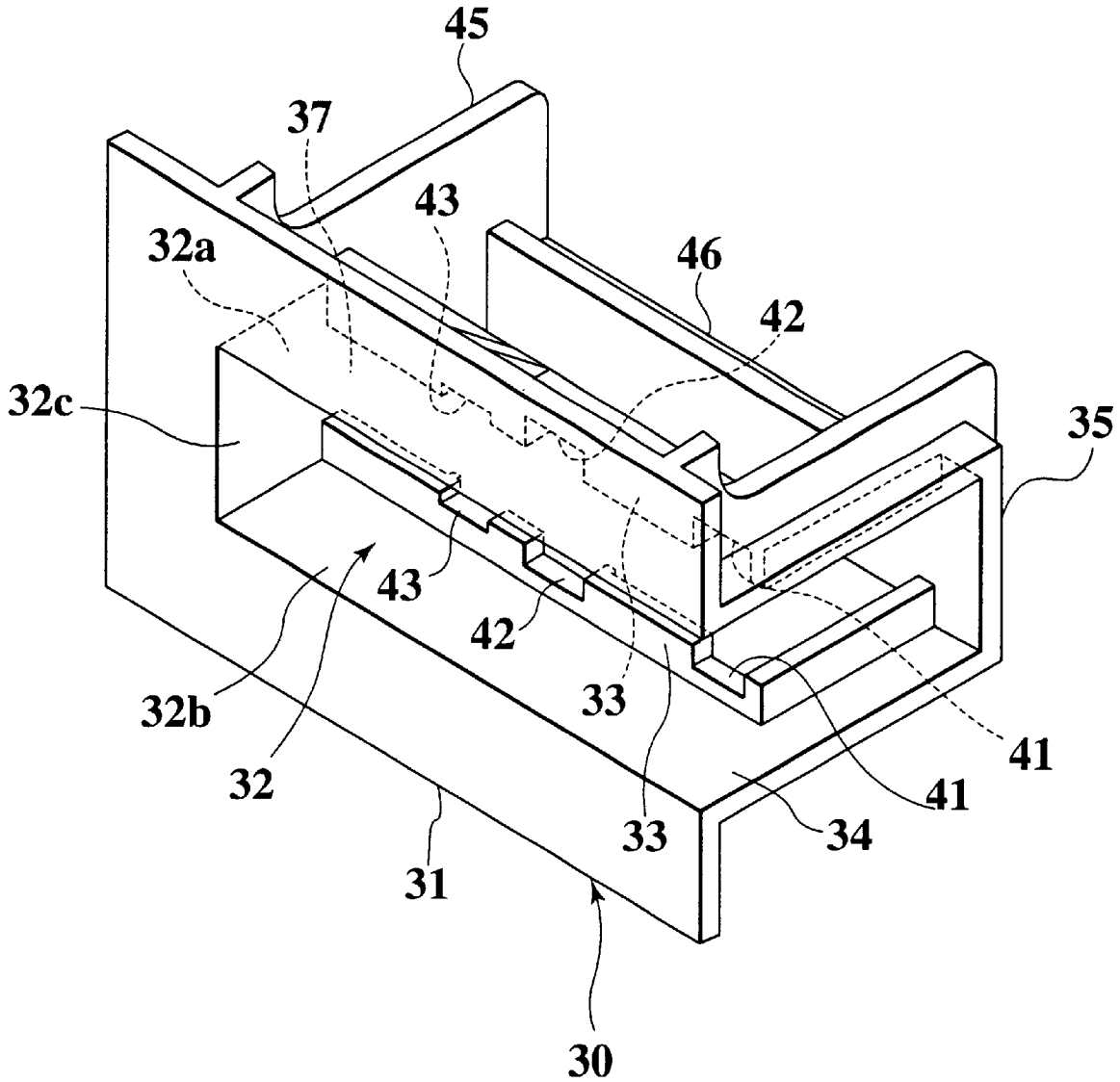
FIG. 9 is a perspective showing a structure of a connector holding member shown in FIG. 6, as viewed from its front side.
Figure 10:
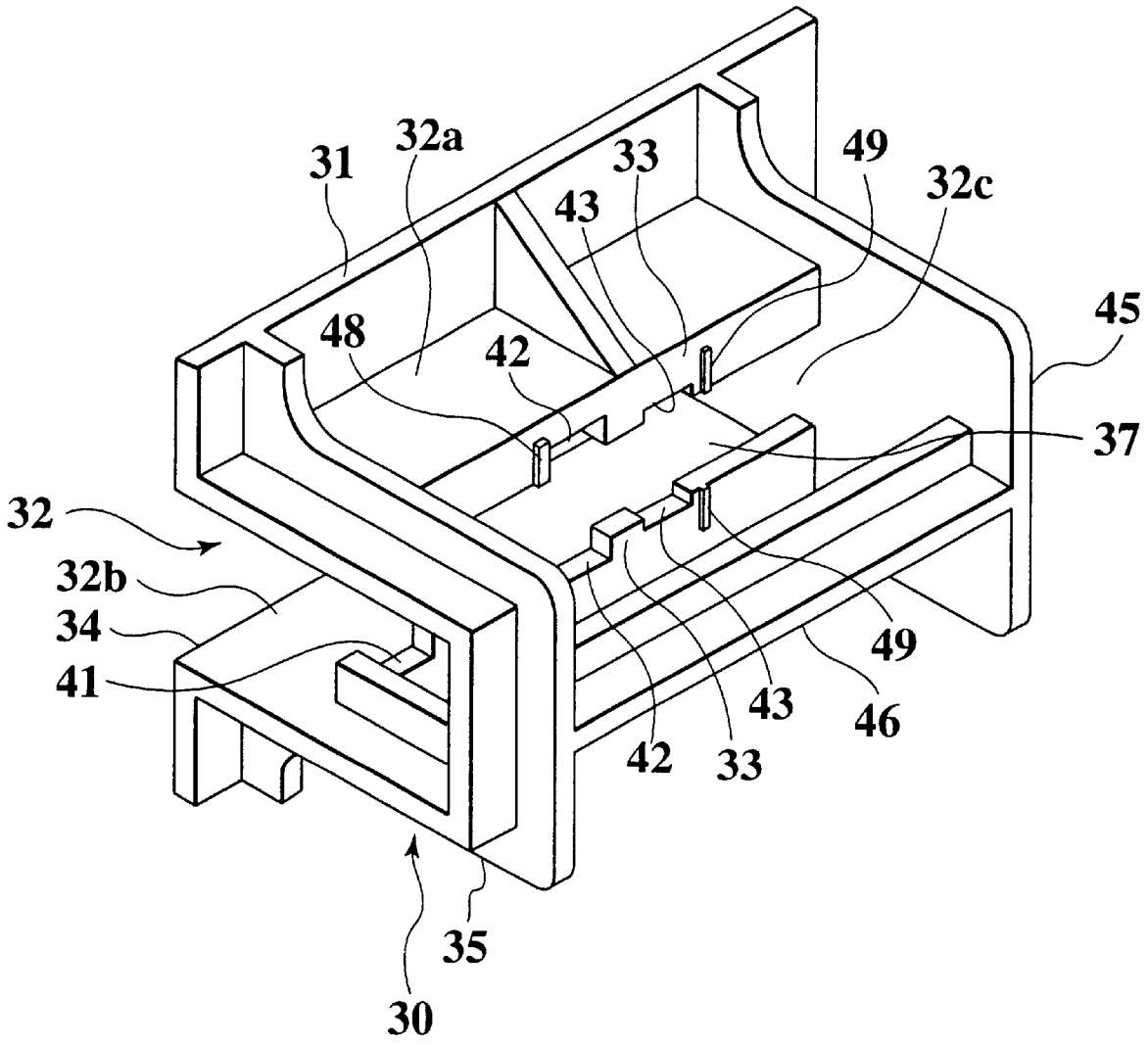
FIG. 10 is a perspective showing the structure of the connector holding member shown in FIG. 6, as viewed from its back side.

Next, a structure of the connector holding member 30 will be explained mainly using FIGS. 9 and 10. FIG. 9 is a perspective as viewed from its front side, and FIG. 10 is a perspective as viewed from its back side.

As shown in FIG. 9, the connector holding member 30 comprises the flat front wall 31 formed with the rectangular recess 32 as viewed front. The recess 32 is roughly defined by three peripheral walls (an upper wall 32*a*, a lower wall 32*b*, and a left side wall 32*c*) and the holding wall 33 corresponding to the bottom wall of the recess. As shown in FIG. 10 also, of the peripheral walls of the recess 32, a right side wall as viewed from front is removed, that portion is defined as an opened side face 34, and is reinforced by a U-shaped frame 35 disposed behind the front wall 31. The left side wall 32*c* is formed as a portion of a left side plate 45 intersecting with the back face of the front wall 31 vertically. The left side plate 45 and the U-shaped frame 35 are connected to each other through a connecting portion 46 disposed behind the holding wall 33 which is the bottom wall of the recess 32, so that the entire connector holding member 30 is formed as an integrally molded material.

A laterally long connector mounting opening 37 is formed on the entire region of the holding wall 33 corresponding to the recess bottom wall from the left side wall 32*c* to the opened side face 34 at a center of the holding wall 33 in the height direction of the holding wall 33. A vertical width of the mounting opening 37 is set to such a size that most of portions of the first connector 50 having the first connector body 51 fitted to the turning levers 70A, 70B can pass through the mounting opening 37 but only the first and second sandwiching projections 74, 75 projecting from the upper and lower faces of the turning levers 70A, 70B can not pass through the mounting opening 37, i.e., only the first and second sandwiching projections 74, 75 abut against the upper and lower holding walls 33 of the mounting opening 37.

In the connector connecting structure of the present embodiment, when the first connector 50 is mounted to the connector holding member 30, the holding wall 33 is sandwiched between the first and second sandwiching projections 74, 75. At that time, the second sandwiching projection 75 must be positioned on the side of the back face of the holding wall 33.

Thereupon, the upper and lower holding walls 33 of the mounting opening 37 are provided at edges thereof (a lower edge of the upper holding wall 33 and an upper edge of the lower holding wall 33) with first and second notches 41, 42 for allowing the second sandwiching projections 75 of the right and left turning levers 70A, 70B to pass through to the back face side of the holding walls 33.

The first notch 41 is for allowing the second sandwiching projection 75 of the right turning lever 70A to pass through to the back face side of the holding wall 33, and is disposed near the opened side face 34 (right side). The second notch 42 is for allowing the second sandwiching projection 75 of the left turning lever 70B to pass through to the back face side of the holding wall 33, and is disposed far from the opened side face 34 (left side). The second notch 42 is formed at its further left side with an escaping notch 43 which is smaller than the first and second notches 41, 42. The escaping notch 43 is for escaping the driving projection 80 so that the latter does not interfere with the holding wall 33.

Figure 11:
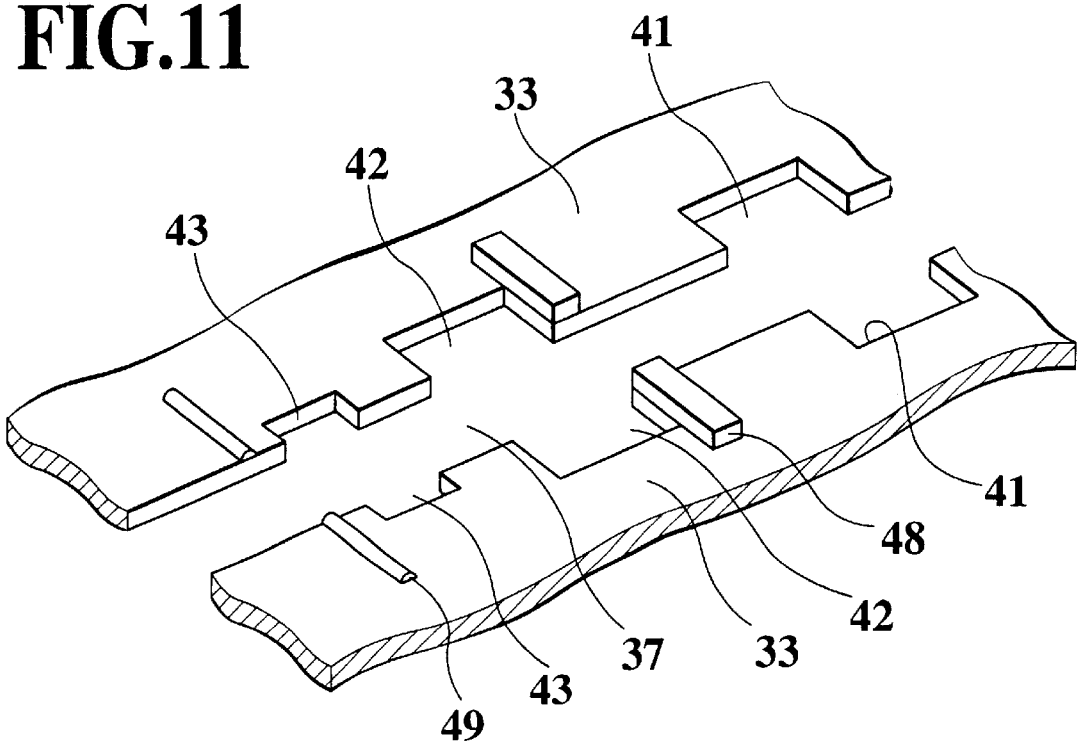
FIG. 11 is a perspective showing a back side of a holding wall of the connector holding member shown in FIG. 9.

FIG. 11 shows a structure of a back face side of the holding wall 33. The holding wall 33 is provided at its back face with a first position-restricting projection (position-restricting portion) 48 and a second position-restricting projection (position-restricting portion) 49. When the holding wall 33 is viewed from front, the first position-restricting projection 48 is disposed on a predetermined position which is on the left side of the first notch 41 and right side of the second notch 42. The second position-restricting projection 49 is disposed on a predetermined position which is on the left side of a third notch 43 located leftward adjacent to the second notch 42.

The first position-restricting projection 48 located on the right side as viewed from front engages the second sandwiching projection 75 of the right turning lever 70A to restrict the leftward movement of the first connector 50. The second position-restricting projection 49 located on the left side as viewed from front engages the second sandwiching projection 75 of the left turning lever 70B to restrict the rightward movement of the first connector 50.

Figure 12:
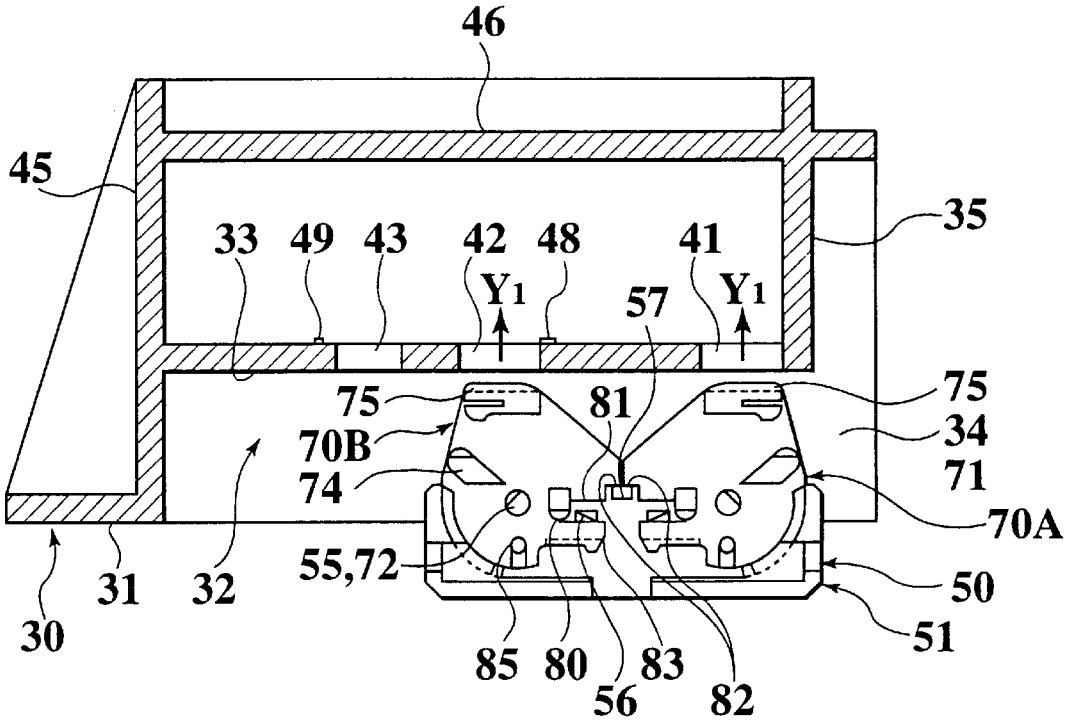
FIG. 12 is a partially sectional plan view showing an initial state where the first connector is mounted to the connector holding member.
Figure 13:
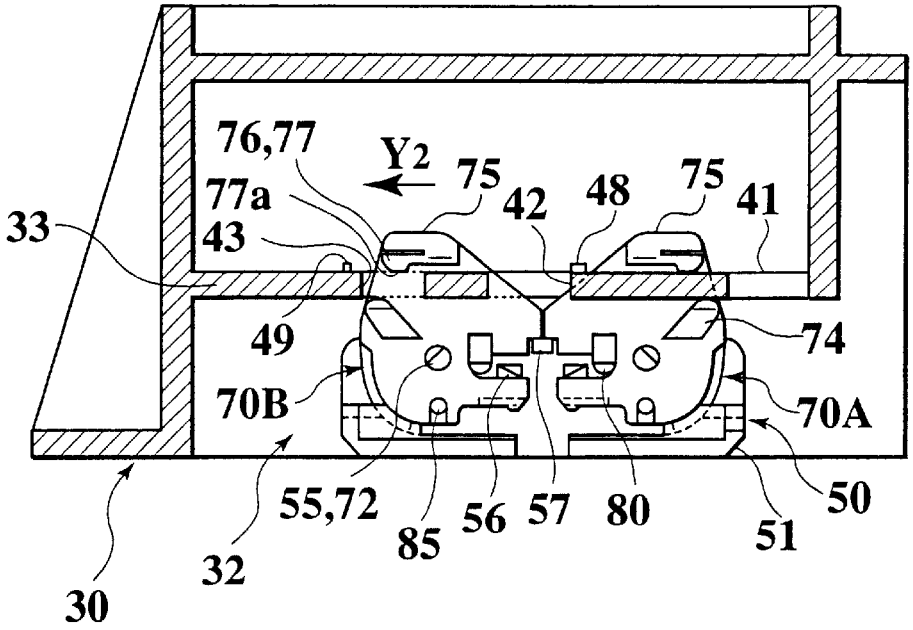
FIG. 13 is a partially sectional plan view showing a next step of that shown in FIG. 12.
Figure 14:
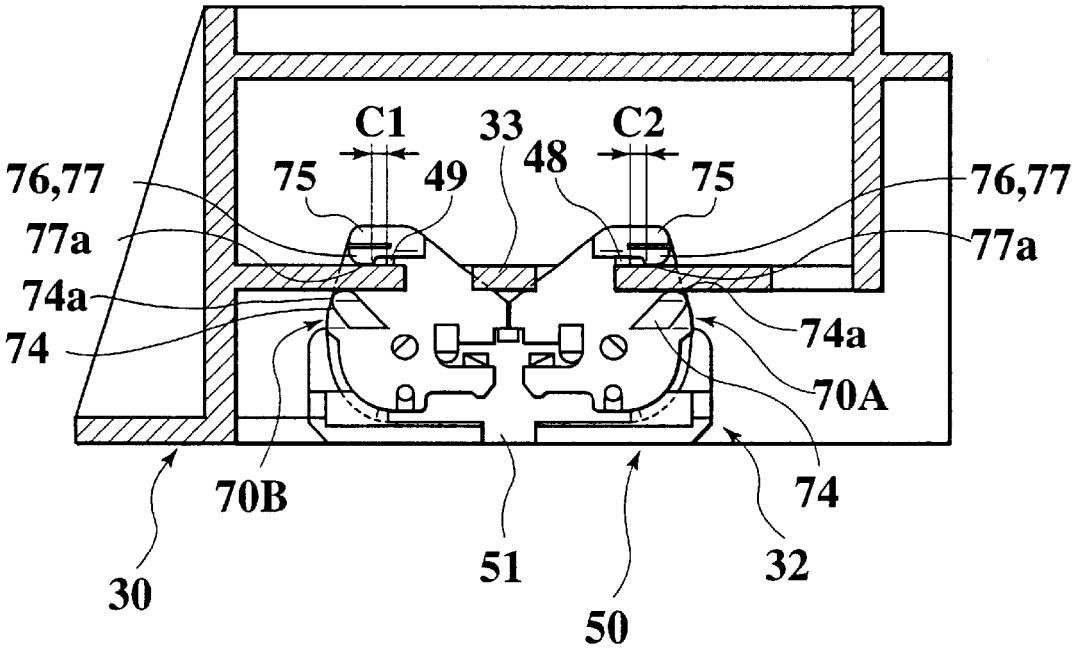
FIG. 14 is a partially sectional plan view showing a state where a next step of that shown in FIG. 13 is carried out and the first connector is temporarily mounted to the holding wall of the connector holding member.

As shown in FIGS. 12, 13 and 14, the second sandwiching projections 75, 75 of the right and left turning levers 70A, 70B are inserted into back sides of the holding walls 33 through the first notch 41 and the second notch 42, respectively, and in this state, the second sandwiching projections 75 are slid leftward along the back faces of the holding walls 33. Therefore, the locking projection 77 of the second sandwiching projection 75 of the right turning lever 70A does not need to ride over the first position-restricting projection 48, but the locking projection 77 of the second sandwiching projection 75 of the left turning lever 70B needs to ride over the second position-restricting projection 49.

Thereupon, the first position-restricting projection 48 which does not need to ride over the locking projection 77 is formed as a projection having a great rectangular cross section, and the second position-restricting projection 49 which needs to ride over the locking projection 77 is formed as a projection having a small semi-circular cross section so that the second position-restricting projection 49 can ride over the locking projection 77 easily.

[Second Connector]

Next, a structure of the second connector 90 will be explained with reference to FIGS. 19 to 23. FIGS. 19 to 23 show the second connector 90 taken along the arrow XIX—XIX in FIG. 6.

In the second connector 90, the hood portion which is to be fitted to the first connector 50 comprises a hood upper wall 90*a*, a hood lower wall 90*b*, and hood left and right side walls 90*c*, 90*d*. A partition wall 90*e* is provided in a deep portion in the hood portion, and a through hole (not shown) into which tip ends of the male terminal metal fittings (not shown) are inserted is formed there.

Figure 22:
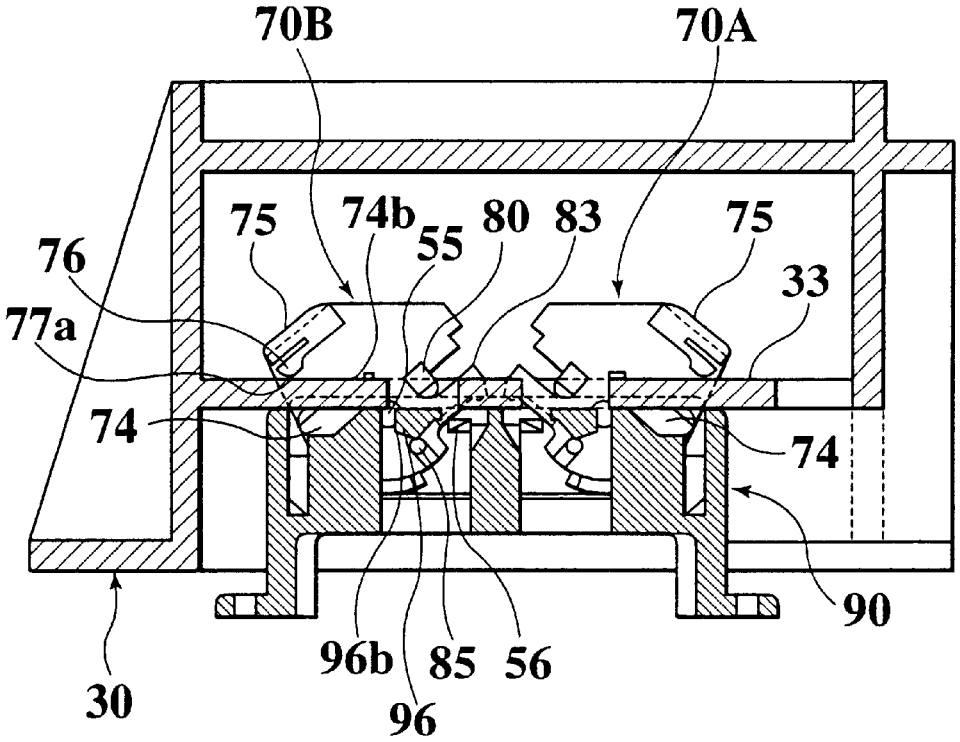
FIG. 22 is a partially sectional plan view showing a next step of that shown in FIG. 21.
Figure 23:
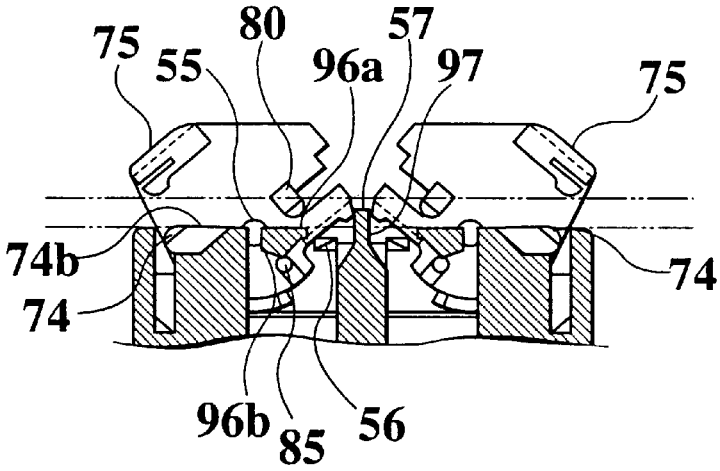
FIG. 23 is a partially sectional plan view showing a portion which is hidden in FIG. 22.

Notches 98 are formed in opposite front ends of the hood upper wall 90*a* and the hood lower wall 90*b* in the laterally widthwise direction. As shown in FIGS. 22 and 23, the first sandwiching projections 74 of the turning levers 70A, 70B are fitted into the notches 98 in the final stage in which the second connector 90 is fitted to the first connector 50.

Figure 20:
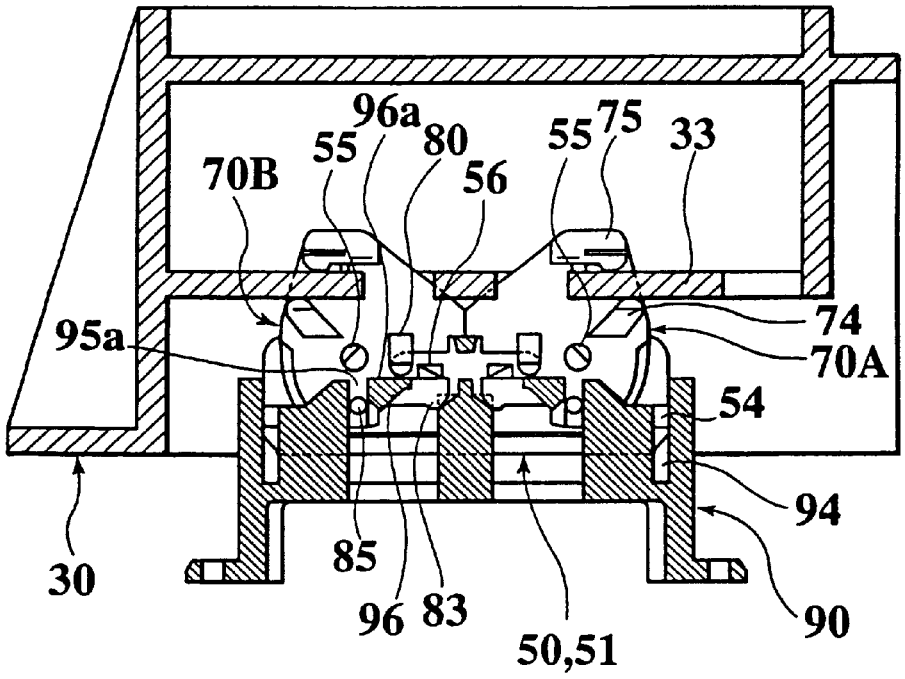
FIG. 20 is a partially sectional plan view showing a next step of that shown in FIG. 19.

As shown in FIG. 20, opposite end inner surfaces of the hood upper wall 90*a* in the laterally widthwise direction are formed with guide grooves 94 in which the guide projections 54 projecting from upper faces of both sides of the first connector body 51 are inserted and guided.

As shown in FIG. 6, some kinds of recesses and projections are formed on inner faces of the hood upper wall 90*a* and the hood lower wall 90*b*. These recesses and projections are formed symmetrically in the lateral direction with respect to the central portion of the second connector 90 in its widthwise direction. Here, the recesses and the projections will be explained while defining the central side of the second connector 90 in its widthwise direction as "inner side", and defining the opposite side as "outer side".

The inner faces of the hood upper wall 90*a* and the hood lower wall 90*b* are formed with the recesses 95 which are lower than the inner faces by one step, and central projections 97 which are higher by one step. The recesses 95 are formed on the both sides of the central projections 97. The recesses 95 are formed from the front end to the rear end with constant width while leaving an island-like hill-like projection 96 located on the front end side of the second connector 90, and the rear ends of the recesses 95 are in communication with mold-draw holes 90*f* formed in the partition wall 90*e*.

By forming the recesses 95 in such forms, the hill-like projection 96 is provided at its outer side with introducing grooves 95*a* having the recesses 95 in which the locking projections 85 of the turning levers 70A, 70B are introduced as shown in FIG. 20. The hill-like projection 96 is located at a position corresponding to the driving projection 80 of the turning levers 70A, 70B, and the front end face 96*a* of the hill-like projection 96 formed as a front end face of the, second connector 90 is a face against which the driving projection 80 abuts when the connectors are fitted to each other. A hill-like peripheral face 96*b* of the hill-like projection 96 is a face with which the locking projection 85 engages.

The central projections 97 passes through a central notch 53 (see FIG. 6) of the first connector body 51 and at the final stage of the fitting operation, a front end of the central projections 97 abuts against the second locking projection 57 projecting from the upper face of the first connector body 51, to push and move the second locking projection 57.

[Operation]

The operation will be explained next.

First, as shown in FIG. 6, the pinholes 72 of the left and right turning levers 70A, 70B are fitted to the turning pins 55, 55 of the first connector body 51, thereby assembling the first connector 50. At that time, the first locking notch 81 and the second locking notch 82 of the turning levers 70A, 70B are engaged with the first locking projections 56, 56 and the second locking projection 57 of the first connector body 51, thereby establishing the initial stage as illustrated. By establishing the initial stage, the turning levers 70A, 70B are not rotated unintentionally.

Next, as shown in FIG. 12, the assembled first connector 50 is inserted into the recess 32 of the connector holding member 30 from its rear portion side, and the second sandwiching projections 75, 75 of the left and right turning levers 70A, 70B located on the rear portion of the first connector 50 are positioned on the first and second notches 41, 42 provided in the holding walls 33 corresponding to the recess bottom walls. Then, the second sandwiching projections 75, 75 are inserted to the back faces of the holding walls 33 as shown with the arrow Y1 in the drawing.

Next, as shown in FIG. 13, the first connector 50 is moved leftward as shown with the arrow Y2 in the drawing. Then, the second sandwiching projection 75 slides along the back face of the holding wall 33, the locking projection 77 of the resilient arm 76 provided on the second sandwiching projection 75 slides on the back face of the holding wall 33. At that time, the first sandwiching projections 74 and the second sandwiching projections 75 of the right and left turning levers 70A, 70B sandwich the holding wall 33.

Figure 17:
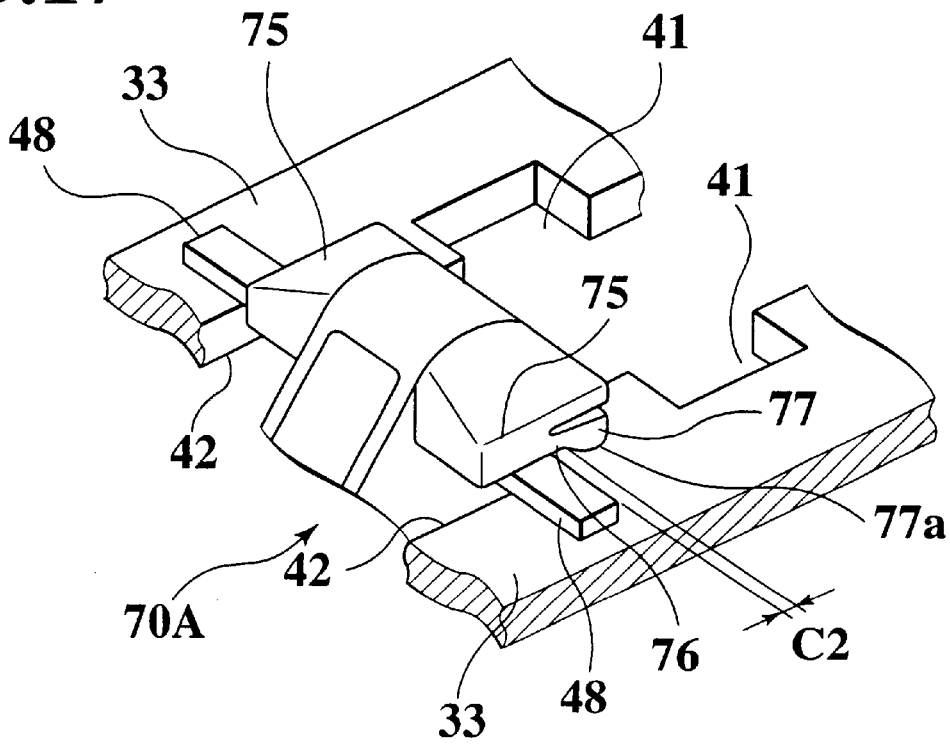
FIG. 17 is a perspective view showing a portion of a structure of the back side of the holding wall in the same condition as that shown in FIG. 14.
Figure 18:
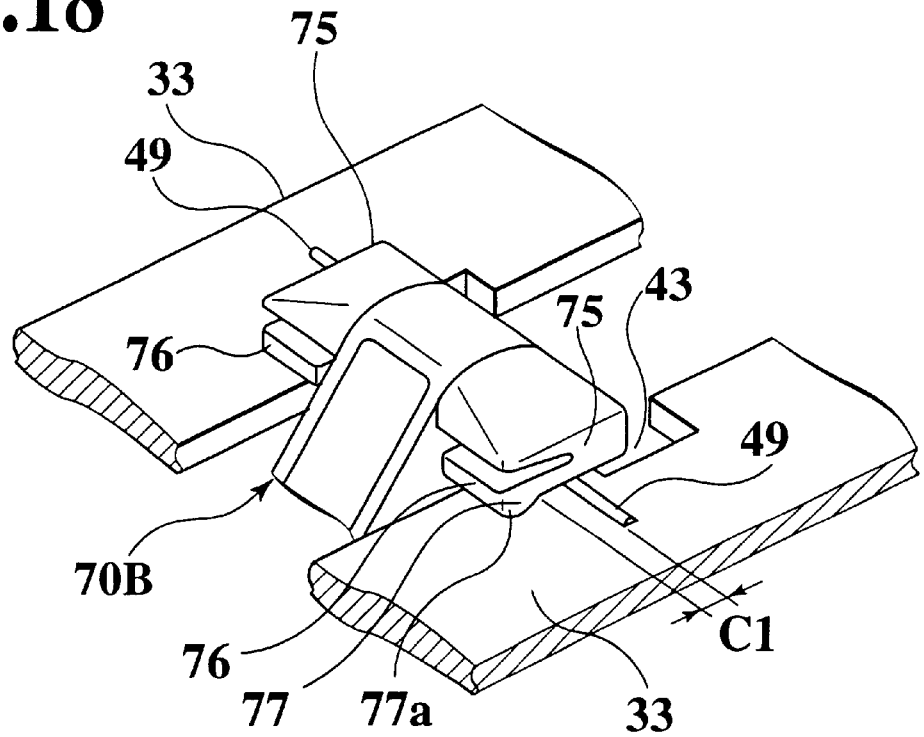
FIG. 18 is another perspective view showing a portion of a structure of the back side of the holding wall in the same condition as that shown in FIG. 14.

If the first connector 50 is slid leftward by a predetermined amount, as shown in FIGS. 14 and 18, the locking projection 77 of the left turning lever 70B rides over the second position-restricting projection 49, and if an attempt is made to further slide the first connector 50, the locking projection 77 of the right turning lever 70A abuts against the first position-restricting projection 48 as shown in FIG. 17, and the first connector 50 can not slide any more.

In this state, the leftward movement of the first connector 50 is restricted by the first position-restricting projection 48, and the rightward movement thereof is restricted by the second position-restricting projection 49. In this case, backlashes C1, C2 are secured between the locking projections 77, 77 and the position-restricting projections 48, 49 and therefore, the first connector 50 can be adjusted in position in the lateral direction by a distance corresponding to the total of C1+C2.

Figure 15:
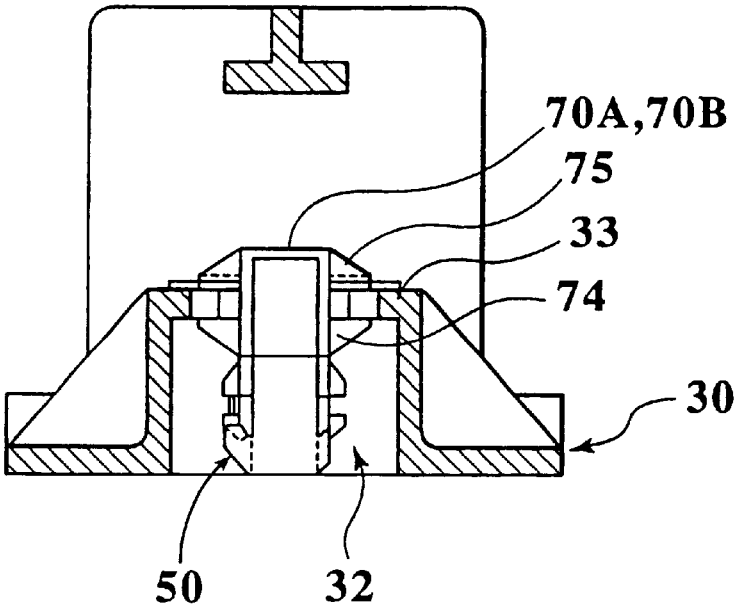
FIG. 15 is a side view showing the same condition as that shown in FIG. 14.
Figure 16:
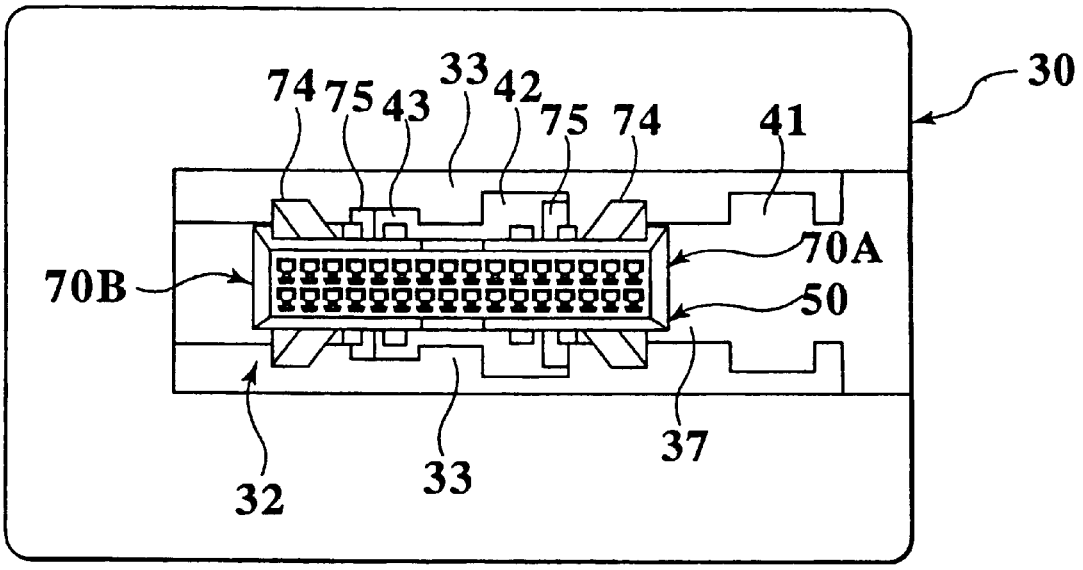
FIG. 16 is a front view showing the same condition as that shown in FIG. 14.

By sandwiching the holding wall 33 between the sandwiching projections 74, 75 in this manner, the first connector 50 is temporarily engaged at the substantially constant position as shown in FIGS. 14, 15 and 16.

In this state, the cylindrical sandwiching surface 77*a* of the locking projection 77 of the resilient arm 76 abuts against the back face side of the holding wall 33 as shown in FIG. 14, and the cylindrical sandwiching surface 74*a* of the first sandwiching projection 74 abuts against the front face side. Further, as shown in FIGS. 14 and 15, the first connector 50 is accommodated such as to hide in the recess 32 of the connector holding member 30 such that the front end of the first connector 50 is pulled into the recess 32 (including the case where the front end is equal to the front wall 31).

[Operation at the Time of Ritting of the Connectors]

Next, the operation to fit the second connector 90 to the first connector 50 mounted to the connector holding member 30 will be explained.

Figure 19:
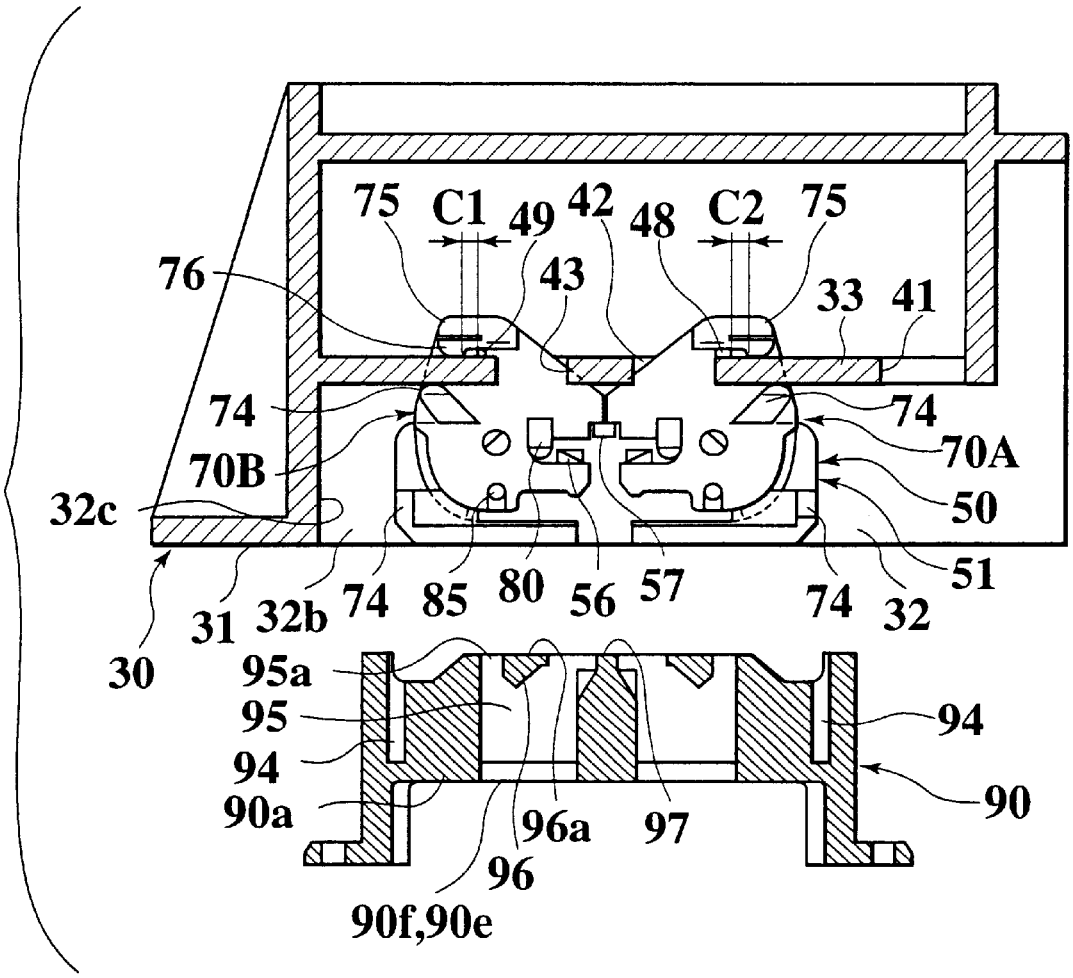
FIG. 19 is a partially sectional plan view showing an initial state where a second connector is fitted to the first connector which is mounted to the connector holding member.

When the second connector 90 is fitted, as shown in FIG. 19, the front face of the second connector 90 is first brought to a position opposed to the recess 32 of the connector holding member 30 as shown in FIG. 19. Then, the second connector 90 is pushed toward the first connector 50 which is temporarily engaged in the recess 32.

At that time, the first connector 50 is accommodated in the recess 32, and is not projected and exposed outside. Therefore, even if attempt is made to fit the second connector 90 in a state where the second connector 90 is deviated in location, the front wall 31 of the connector holding member 30 or the inner peripheral wall (the upper wall 32*a*, the lower wall 32*b* and the left side wall 32*c*) and the like first abut against the second connector 90, and these portions absorb a force applied unintentionally. Further, since the second connector 90 is guided by the inner peripheral wall (the upper wall 32*a*, the lower wall 32*b* and the left side wall 32*c*) of the recess 32 as the hood portion, no improper lateral force is applied to the first connector 50 and thus, the temporarily engagement of the first connector 50 is not released.

Therefore, it is possible to push the second connector 90 toward the first connector 50 in the recess 32 with appropriate force and direction irrespective of the operating state.

Further, since the first connector 50 can slightly be adjusted in position in the lateral direction by the backlashes C1+C2 at the time of the fitting operation, both the connectors 50 and 90 can easily be aligned by the operation of an alignment mechanism.

Next, if the second connector 90 starts fitting to the first connector 50, as shown in FIG. 20, the guide projections 54 of the first connector 50 is inserted into the guide grooves 94 of the second connector 90 and guided. therein, and the locking projections 85 of the turning levers 70A, 70B of the first connector 50 are inserted into the introducing grooves 95*a* of the recesses 95 of the second connector 90.

Figure 21:
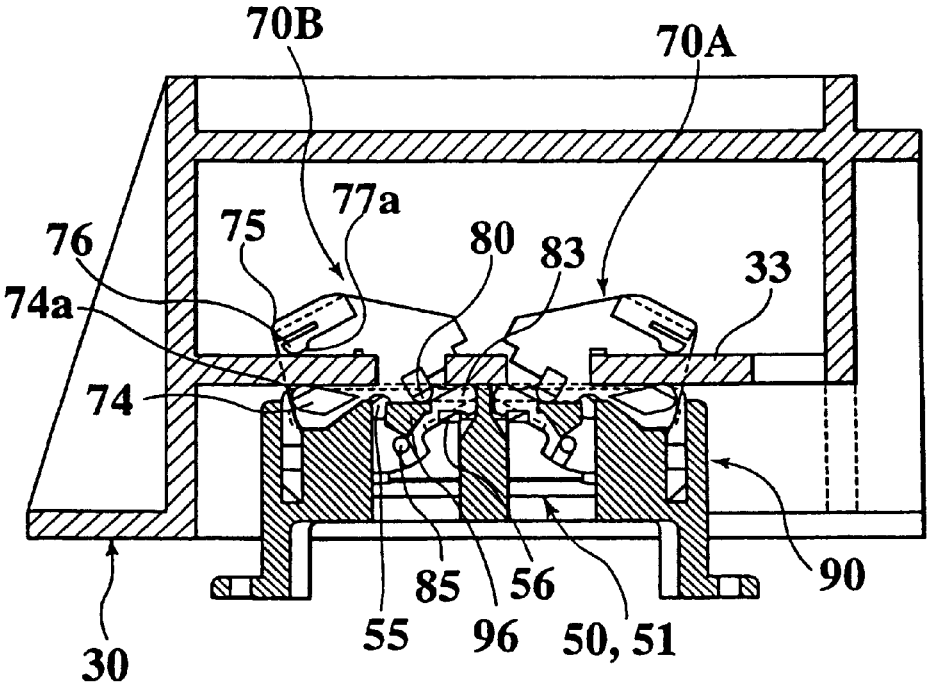
FIG. 21 is a partially sectional plan view showing a next step of that shown in FIG. 20.

If the fitting operation is further proceeded, as shown in FIG. 21, a front end face 96*a* (see FIG. 6) of the hill-like projection 96 of the second connector 90 abuts against the driving projection 80 of the turning levers 70A, 70B, and the driving projection 80 is pushed and moved rearwardly. With this movement, rotation moments in the laterally opposite directions are generated in the turning levers 70A, 70B, the locking arm 83 rides over the first locking projections 56, 56, and the turning levers 70A, 70B start turning around the turning pins 55, 55.

The locking projection 85 slides on the hill-like peripheral face 96*b* (see FIG. 6) and enters into the recesses 95 by the movements of the turning levers 70A, 70B. The positional relation between the first and second sandwiching projections 74 and 75 sandwiching the holding wall 33 from the front and back faces is moved and with this movement, the first connector 50 is displaced toward the holding wall 33.

At that time, both the cylindrical sandwiching surfaces 74*a*, 77*a* of the sandwiching projections 74, 75 are in contact with the front and back faces of the holding wall 33. Because the cylindrical sandwiching surface 77*a* is part of the resilient arm 76, the turning levers 70A, 70B smoothly turn without rattle.

Especially, because the resilient arm 76 can be deformed in the thickness direction of the holding wall 33, various size errors which exert influences to engaging portions including a thickness error of the holding wall 33 can be absorbed. Therefore, it is possible to ensure the smooth turning movements of the turning levers 70A, 70B, and to ensure the smooth mounting operation.

In a state shown in FIG. 21, the first connector 50 and the second connector 90 are fitted to each other, and brought into electrical communication with each other.

Then, by further pushing the second connector 90, the turning levers 70A, 70B are turned and brought into the fitting ensuring state shown in FIG. 22 and 23.

That is, if the second connector 90 is pushed in, the central projections 97 of the second connector 90 push and move the second locking projections 57 of the turning levers 70A, 70B and with this, the first connector 50 is further pushed and moved toward the holding wall 33. In this state, the entire flat sandwiching faces 74*b* of the first sandwiching projections 74 on the turning levers 70A, 70B are brought into tight connection with the surface of the holding wall 33, the turning levers 70A, 70B are finally engaged with the holding wall 33 of the connector holding member 30, the locking projection 85 moves to a position exceeding an apex of the hill-like projection 96, and the fitting state between the first and second connectors 50 and 90 is ensured.

At that time, since the holding wall 33 is sandwiched between the flat sandwiching face 74*b* of the first sandwiching projection 74 and the cylindrical sandwiching face 77*a* of the resilient arm 76 of the second sandwiching projection 75, it is possible to reliably hold the first connector 50 and the second connector 90 which is fitted to the first connector 50 without rattle, and the fitting state is not deteriorated by the vibration or the like.

[Separation]

Next, the operation when the second connector 90 is separated from the fitted state will be explained.

In order to separate the second connector 90, a pulling-out force is applied thereto. Then, the turning levers 70A, 70B are turned in the directions opposite from those described above, and the driving projection 80 abuts against the front face of the second connector 90 (front end face 96*a* of the hill-like projection).

Figure 24:
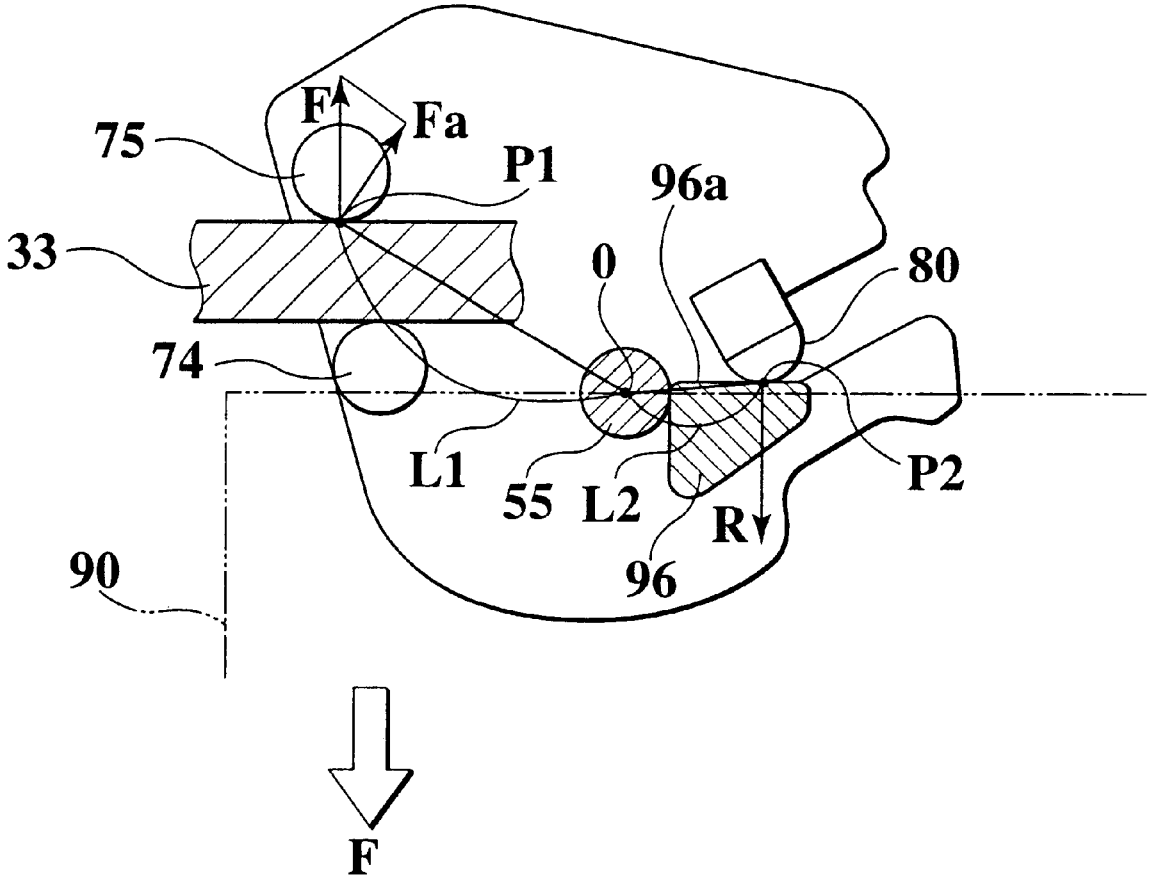
FIG. 24 is a schematic diagram showing a relation of force when the second connector is separated from the fitted state shown in FIGS. 22 and 23.

FIG. 24 shows such a state in an enlarged scale and simplified manner.

If the pulling-out force F is applied, the force F is transmitted to the locking projection 77 of the first sandwiching projection 75. If a point to which the force is applied is defined as P1 (engaging point) and a distance between the P1 and a center O of the turning pin 55 is defined as L1, a rotation moment (Fa×L1) is generated around the center O of the turning pin 55 by a partial force Fa.

On the other hand, if a point where the driving projection 80 abuts against the front end face of the second connector 90 (front end face 96*a* of the hill-like projection 96) is defined as P2 and a distance between the P2 and the center O is defined as L2 (L1>L2), a force R transmitted from the driving projection 80 to the second connector 90 becomes about (Fa×L1/L2.

Here, since the L1 is set sufficiently greater than the L2, the force R (auxiliary force for separation) which is increased from the pulling-out force F by the action of the lever is transmitted to the front end of the second connector 90, and the second connector 90 can easily be separated from the first connector 50.

Figure 25:
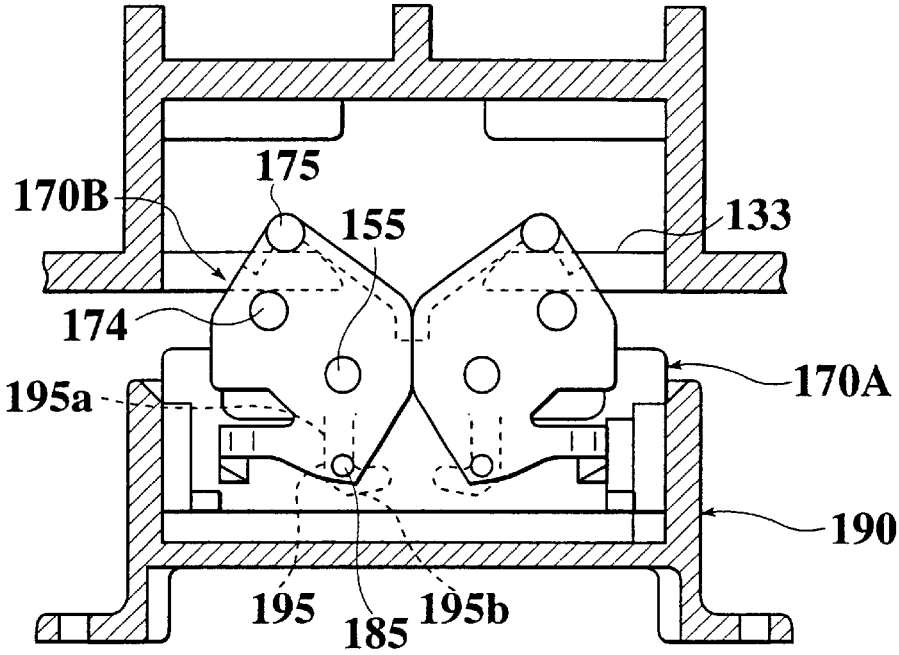
FIG. 25 is a plan view of a structure shown as a comparative example of the embodiment of the present invention.
Figure 26:
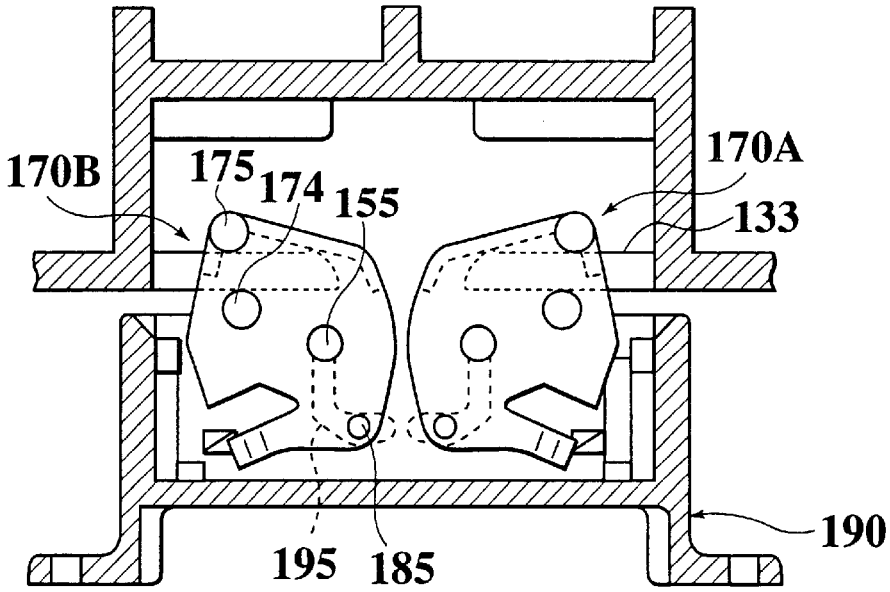
FIG. 26 is a plan view showing the second connector which is further pushed from the state shown in FIG. 25.

In this case, as shown in FIGS. 25 and 26, an operation similar to that described above can be obtained by a combination of a guide groove having a curved portion and a pin which slides along the guide groove. In FIGS. 25 and 26, a reference symbol 190 represents a second connector, a reference symbol 195 represents a guide groove on the side of the second connector 190, a reference symbol 195*a* represents an introducing groove, a reference symbol 195*b* represents a curved portion, reference symbols 170A and 170B represent turning levers, a reference symbol 155 represents a turning pin, a reference symbol 175 represent s a second sandwiching projection, and a reference symbol 185 represents a pin sliding on the guide groove 195.

However, in the case of the structure using the guide groove 195, since it is necessary to strictly set the size and shape of the guide groove 195, workability at the time of resin forming is inferior (especially, mold-drawing is difficult). When it is molded with resin. Whereas, in the structure in which the driving projection 80 is abutted directly against the front end face of the second connector 90 as in the above embodiment, since it is unnecessary to form the guide groove, it is easy to work, and is advantageous when it is molded with resin. The same can be said to the prior art shown in FIGS. 1 to 5.

In the present embodiment, the second connector 90 is formed with the recesses 95, and the locking projection 85 is introduced into the recesses 95 as shown in FIG. 6. This portion is not a portion where the rotational driving force is applied to the turning levers 70A, 70B and the auxiliary force for separating the connectors is generated. Therefore, it is unnecessary to form this portion into a guide groove shape, and this portion can be opened by bringing the rear end thereof into communication with the mold-draw hole 90*f*. Therefore, a problem of mold-drawing at the time of forming is not generated, and an excellent workability can be ensured.

What is claimed is:

1. A connector connecting structure comprising:

a connector holding member including a holding wall having a front and back face side;

a first connector held by said connector holding member;

a second connector to be fitted to said first connector; and a turning lever provided on said first connector, said turning lever including a first and second sandwiching projection provided on one end thereof, said first and second sandwiching projections respectively abutting said front and back face sides of said holding wall to hold the turning lever in a temporarily engaged position before said second connector is fitted to said first connector by turning said turning lever to a finally engaged position, wherein said holding wall includes a position-restricting portion provided on the back face side thereof, said position-restricting portion being engageable with said second sandwiching projection to prevent said turning lever from moving in a lateral direction along said holding wall.

2. The connector connecting structure according to claim 1, wherein the second sandwiching projection includes a resilient arm and said resilient arm abuts said back face side of said holding wall.

3. The connector connecting structure according to claim 1, wherein said turning lever in said temporarily engaged position is movable in said lateral direction by a predetermined distance before said second sandwiching projection engages with said position-restricting portion.

4. A connector connecting structure comprising:

a connector holding member having an inner peripheral wall and a holding wall extending from said inner peripheral wall;

a first connector held by said holding wall;

a second connector to be fitted to said first connector, said second connector having a front end face; and a turning lever provided on said first connector, said turning lever including a driving projection protruding from a surface thereof, said front end face of said second connector pushing said driving projection to turn said turning lever when said second connector is fitted to said first connector.

5. A connector connecting structure comprising:

a connector holding member having an inner peripheral wall and a holding wall extending from said inner peripheral wall;

a first connector held by said holding wall;

a second connector to be fitted to said first connector, said second connector having a front end face; and a turning lever provided on said first connector, said turning lever including a driving projection protruding from a surface thereof, said driving projection pushing said front end face of said second connector to separate said second connector from said first connector when said second connector fitted to said first connector is pulled.

6. The connector connecting structure according to claim 5, wherein when said second connector fitted to said first connector is pulled, a lever action resulting from rotation of said turning lever amplifies a pulling-out force applied to an engaged point between said turning lever and said holding member and said driving projection transmits said amplified pulling-out force to said front end face as a pushing force to separate said second connector from said first connector.

7. A connector connecting structure comprising:

a connector holding member having an inner peripheral wall and a holding wall extending from said inner peripheral wall;

a first connector held by said holding wall;

a second connector to be fitted to said first connector, said second connector having a front end face; and a turning lever provided on said first connector, said turning lever including a driving projection protruding from a surface thereof, said front end face of said second connector pushing said driving projection to turn said turning lever when said second connector is fitted to said first connector, said driving projection pushing said front end face of said second connector to separate said second connector from said first connector when said second connector fitted to said first connector is pulled.

8. The connector connecting structure according to claim 7, wherein when said second connector fitted to said first connector is pulled, a lever action resulting from rotation of said turning lever amplifies a pulling-out force applied to an engaged point between said turning lever and said holding member and said driving projection transmits said amplified pulling-out force to said front end face as a pushing force to separate said second connector from said first connector.

9. The connector connecting structure according to claim 7, wherein said turning lever further includes a first and second sandwiching projection provided on one end thereof and said holding wall of said connector holding member has a front and back face side, said first and second sandwiching projections respectively abutting said front and back face sides of said holding wall to hold the turning lever in a temporarily engaged position before said front end face of said second connector pushes said driving projection to turn said turning lever toward a finally engaged position.

10. A connector connecting structure comprising:

a connector holding member including a front face wall having a recess formed therein, said recess having an inner peripheral wall and a holding wall extending from said inner peripheral wall;

a first connector held by said holding wall; and a second connector fitted to said first connector, said inner peripheral wall of said recess guiding said second connector when said second connector is fitted to said first connector, wherein said first connector is positioned in said recess without any portion thereof protruding from said front face wall of said connector holding member when said first connector is held by said holding wall before said second connector is fitted to said first connector.

11. The connector connecting structure according to claim 10, further comprising engaging means provided on said first connector, said engaging mean being engaged with said holding wall in a temporarily engaged position before being engaged with said holding wall in a finally engaged position by fitting said second connector to said first connector.

12. The connector connecting structure according to claim 11, wherein said engaging means is a turning lever and said second connector turns said turning lever to said finally engaged position.

13. The connector connecting structure according to claim 12, wherein said holding wall has a front and back face side and said turning lever further includes a first and second sandwiching projection provided on one end thereof, said first and second sandwiching projections respectively abutting said front and back face sides of said holding wall to hold the turning lever in said temporarily engaged position before said second connector is fitted to said first connector to turn said turning lever to said finally engaged position.

* * * * *

UNITED STATES PATENT AND TRADEMARK OFFICE

CERTIFICATE OF CORRECTION

PATENT NO. : 6,390,835 B1 
DATED : May 21, 2002
INVENTOR(S) : Toshiaki Okabe and Kenji Oishi It is certified that error appears in the above-identified patent and that said Letters Patent is hereby corrected as shown below:

Title page,
Item [57], ABSTRACT,
Line 13, after "face" and before "or a holding wall", insert -- side --.

Column 20,
Line 6, "engaging mean" should read -- engaging means --.

Signed and Sealed this

Seventh Day of January, 2003

JAMES E. ROGAN
*Director of the United States Patent and Trademark Office*